US007302203B2

(12) United States Patent
Morimoto et al.

(10) Patent No.: US 7,302,203 B2
(45) Date of Patent: Nov. 27, 2007

(54) IMAGE FORMING APPARATUS

(75) Inventors: Hiroshi Morimoto, Akiruno (JP); Mikihiko Takada, Hino (JP); Shigetaka Kurosu, Hino (JP); Satoshi Nishida, Saitama (JP)

(73) Assignee: Konica Minolta Business Technologies, Inc. (JP)

( * ) Notice: Subject to any disclaimer, the term of this patent is extended or adjusted under 35 U.S.C. 154(b) by 70 days.

(21) Appl. No.: 11/042,635

(22) Filed: Jan. 25, 2005

(65) Prior Publication Data

US 2005/0180773 A1 Aug. 18, 2005

(30) Foreign Application Priority Data

Feb. 16, 2004 (JP) ..... 2004-037873
Mar. 2, 2004 (JP) ..... 2004-057279
Mar. 26, 2004 (JP) ..... 2004-091294

(51) Int. Cl.
*G03G 15/16* (2006.01)
*G03G 21/00* (2006.01)

(52) U.S. Cl. ..... 399/101; 399/99

(58) Field of Classification Search ..... 399/101, 399/99

See application file for complete search history.

(56) References Cited

U.S. PATENT DOCUMENTS 5,708,942 A * 1/1998 Sugiyama et al. ..... 399/282
6,249,661 B1 * 6/2001 Saitoh et al. ..... 399/117
6,405,002 B2 * 6/2002 Ogiyama et al. ..... 399/101
6,788,913 B1 * 9/2004 Aoki et al. ..... 399/279
6,934,485 B2 * 8/2005 Miyabe et al. ..... 399/90
7,016,639 B2 * 3/2006 Park et al. ..... 399/350
7,127,201 B2 * 10/2006 Takenouchi et al. ..... 399/297
2003/0054269 A1 * 3/2003 Yamazaki et al. ..... 430/45
2004/0240894 A1 * 12/2004 Tomita et al. ..... 399/17
2006/0034632 A1 * 2/2006 Takada et al. ..... 399/101
2006/0056869 A1 * 3/2006 Sato et al. ..... 399/66

FOREIGN PATENT DOCUMENTS

JP 5-40438 2/1993
JP 6-318019 11/1994
JP 7-104627 4/1995
JP 2002-268400 9/2002

* cited by examiner

*Primary Examiner*—Walter Benson
*Assistant Examiner*—Jeff Natalini
(74) *Attorney, Agent, or Firm*—Cantor Colburn LLP

(57) ABSTRACT

An image forming apparatus, is provided with an image forming section, an image carrying member, a transferring section to transfer the toner image from the image carrying member to a recording sheet, and a cleaning section including a cleaning blade being in contact with the image carrying member and a toner supplying section located at an upper stream side of the contact point of the cleaning blade in the rotating direction of the image carrying member and to supply toner to the image carrying member; the toner supplying section including a toner storing section to store toner removed by the cleaning blade and a roller member being in contact with the image carrying member.

26 Claims, 17 Drawing Sheets

FIG. 7 (a)
| | CONDITION A | CONDITION B |
|---|---|---|
| BLADE EDGE DAMAGE RATIO (%) | 2 | 38 |
FIG. 7 (b)
| | CONDITION A | CONDITION B |
|---|---|---|
| BLADE EDGE DAMAGE NEAR THE BLADE CENTER | ○ | △ × |
| BLADE EDGE DAMAGE NEAR THE BLADE ENDS | ○ | × × |
| TONER FILMING NEAR THE CENTER OF THE INTERMEDIATE IMAGE TRANSFER BELT | ○ | △ × |
| TONER FILMING NEAR THE TWO ENDS OF THE INTERMEDIATE IMAGE TRANSFER BELT | ○ | × × |
FIG. 8
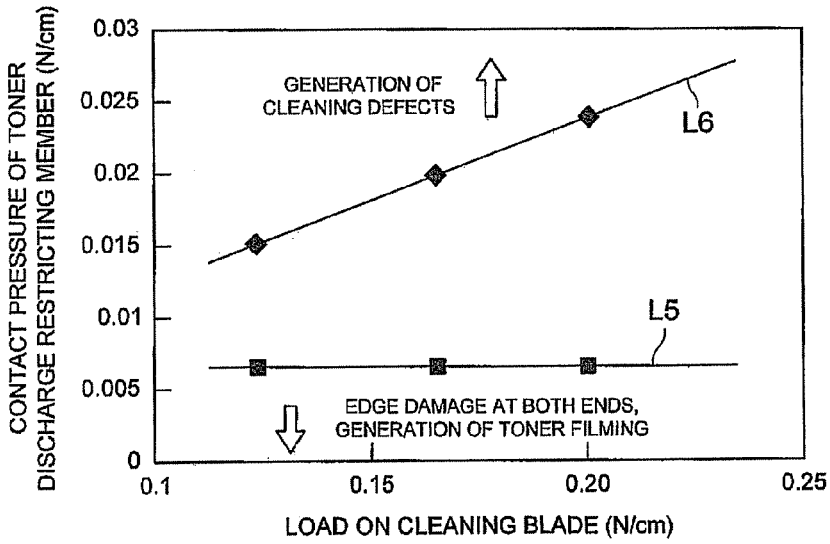
FIG. 9
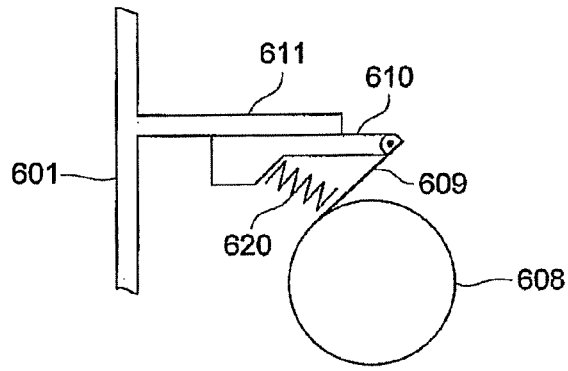

IMAGE FORMING APPARATUS

BACKGROUND OF THE INVENTION

The present invention relates to image forming apparatuses using the electro-photographic method, such as copiers, printers, and facsimile machines, and, in particular, relates to the cleaning means in such apparatuses for removing the toner remaining on the image carrier.

The blade cleaning method is known which is a cleaning method used in an image forming apparatus with a configuration of forming the toner image on a photosensitive member (photoreceptor) having around it various means for charging, exposure, and development, then either directly transferring the toner image onto the transfer medium, or transferring the toner images from plural photosensitive bodies temporarily-onto an intermediate image transfer body and then making a secondary transfer of the toner image on the intermediate image transfer body onto a transfer member, with said cleaning method of removing the toner remaining on the secondary transfer body or on the intermediate image transfer body (both of which are collectively called an image carrier or an image carrying member) by making a blade made of an elastic material such as urethane (hereinafter called the cleaning blade) press against the image carrier in a direction counter to the direction of movement of the image carrier.

In the blade cleaning method, since it is necessary to make the cleaning blade press against the image carrier with a force equal to or greater than a specific value order to scrape off the toner surely, friction is generated between the cleaning blade and the image-carrier and this friction causes problems such as bending of the cleaning blade, damage to the cleaning blade edge, toner filming, and pitch variations of the image caused by changes in the image carrier driving force due to increased friction force.

Toner is structured by a mixture of base materials and external additives, and the base materials are for example pigment, wax, resin, and the external additive is composed of abrasive particles and lubricant such as silica and titania which impart electrification.

When remaining toner is removed from an intermediate image transfer body by a cleaning blade, a part of toner still remains on the edge, though the remaining toner is scraped by the edge of the cleaning blade. Abrasive particles contained in the remaining toner also works as a lubricant, and works to reduce the friction coefficient between the cleaning blade and the intermediate image transfer body by means of insertion of a small amount of them into a clearance between the edge and the intermediate image transfer body, and consequently the blade can continue to remove the remaining toner without being bent.

However, wax and lubricant contained in toner partially adhere to the intermediate image transfer body and makes a thin film by being extended without being removed sufficiently to cause a so-called filming phenomenon in the traveling direction of the intermediate image transfer body.

Further, though it is needed for toner to always gather on the edge, a shortage of toner happens if many copies with low printing ratio, on which a copied image is formed partially, are produced. In case of a shortage of toner, the friction coefficient between the cleaning blade and the intermediate image transfer body rises, and parts of edge where it is short of toner, get damage and hence the wax and lubricant slip under the damaged portion of cleaning blade thereby causing-toner filming.

When a filming phenomenon occurs on an intermediate image transfer body, electric resistance rises at the portion, and electric charge is conducted preferentially into portions where no toner filming occurs in the primary image transfer and the secondary image transfer. Therefore, the image transferability at the portion where toner filming occurs deteriorates, and causes white striations on a recording material.

The following patent documents have been disclosed.

[Patent Document 1] TOKKAI No. 2002-268400

[Patent Document 2] TOKKAI No. HEI5-40438

[Patent Document 3] TOKKAI No. HEI6-318019

[Patent Document 4] TOKKAI No. HEI7-104627

In Patent Document 1, there has been disclosed a image forming apparatus having a cleaning member which uses simultaneously a function cleaning remaining toner on a intermediate image transfer body by means of indirect bias charging with a cleaning bias charging member and a function applying lubricant to a intermediate image transfer body.

A proposal in Patent Document 2 is that of preventing the generation of the above problems by detecting the quantity of toner supplied to the developing unit from the toner supply container section, and depending the result of that detection, sending the image carrier to the cleaning section after forcibly coating it with toner.

This is based on the thinking that the quantity of toner consumed by the image carrier is proportional to the quantity of toner supplied to the developing unit, and if more toner is made to be consumed by the image carrier, the quantity of toner sent to the cleaning section is compulsorily made smaller, and, on the other hand, the control is carried out so that the quantity of toner sent to the cleaning section is made larger if the quantity of toner consumed is smaller.

A proposal in Patent Document 3 is that of preventing the generation of the above problems by detecting the extent of mirror-like condition of the surface of the photosensitive body which is an image carrier, and when the surface of the photosensitive body is highly mirror-like, a high density toner image is formed covering the non-image part of the photosensitive body before the body is sent to the cleaning section, thereby lowering the friction between the photosensitive body and the cleaning blade.

In a proposal in Patent Document 4, the cleaning blade is made to press against the image carrier in a direction counter to the direction of movement of the image carrier, and also, the front edge of the surface pressing against the photosensitive body is made to have a shape so that it recedes in the direction of the movement of the image carrier more and more at locations near the two side edges of the image carrier, that is, from the central part which is the image formation area where the toner image is formed towards the non image forming area at the two sides of the image forming area, thereby transporting the toner scraped off from the central toner image forming area to the non image forming area with the intention of reducing the friction force between the cleaning blade and the image carrier body in the on image forming area.

However, it has not been disclosed that an appropriate quantity of toner is supplied to a clearance between a cleaning edge and an image carrying member (a photoreceptor or an intermediate image-transfer body) in Patent Document 1.

In the method described in the Patent document 2, since the information in the width direction of printing has not been considered, in case the printing width is small and also high density toner image is formed consecutively, the amount of toner consumption will be judged to be high and the quantity of toner supplied to the cleaning section will forcibly be made smaller.

As a consequence, the quantity of toner present as lubricant in the non-printing area becomes insufficient, thereby causing the problems described above such as bending of the cleaning blade, damage to the cleaning blade edge, toner filming, and pitch variations of the image, etc.

In the method described in the Patent document 2, the extent of mirror-like nature of the surface of the photosensitive body in the direction along the axis of rotation will be affected by the history of the printing width. In other words, there will be the problem that the mirror-like nature of the part of the surface of the photosensitive body that is printed commonly irrespective of the printing width will be increasing with more and more use, but the mirror-like nature of the part of the surface of the photosensitive body that is not used much will not increase with time of use. Because of this, if the toner is supplied forcibly to the cleaning section based on the extent of mirror-like nature of the surface of the part of the surface of the photosensitive body that is not used much, the quantity of toner will become insufficient in the part of the surface where the extent of the mirror-like nature has increased, and hence causing the problems described above. On the other hand, if the quantity of toner supplied to the cleaning section forcibly is increased based on the extent of mirror-like nature of the commonly printed part of the photosensitive body, unnecessary quantity of toner will be supplied to the part of the surface where the extent of mirror-like nature has not increased substantially, thereby wastefully consuming the toner.

Further, in the two methods described in Patent documents 2 and 3, since the toner is fed to the cleaning section forcibly, there are simultaneous problems of more time becoming necessary for forming the image thus lowering the productivity and wasteful consumption of the toner if image forming is carried out frequently.

In the method described in the Patent document 4, if toner images with small printing width and low printing ratio are formed consecutively, the quantity of toner removed by the cleaning blade becomes smaller and hence the toner may not reach the two ends of the cleaning blade.

In addition, the hardness of the cleaning blade decreases near its two ends and hence the toner slips under the cleaning blade thereby causing cleaning defects.

SUMMARY OF THE INVENTION

The present invention is one that has taken into consideration the problems described above, and the purpose of the present invention is to provide an image forming apparatus that can solve the problems of bending of the cleaning blade, damage to the cleaning blade edge, toner filming, and pitch variations of the image, etc., without being affected by the printing width or the printing ratio, while at the same time preventing reductions in the productivity and avoiding wasteful consumption of the toner.

The inventors of the present invention concentrated on the toner removed by the cleaning blade, and arrived at the present invention thinking that it is possible to provide lubrication to the cleaning blade without being affected by the printing width or the printing ratio by making the configuration of the apparatus such that the toner removed from the image carrier is not discharged but is left to accumulate as it is in the neighborhood of the cleaning blade thus ensuring that always there is some toner present at the part where the image carrier and the cleaning blade are pressed against each other.

In other words, the purpose of the present invention can be achieved by having the following configuration.

An image forming apparatus comprising, (1) a toner image forming section to form toner images, (2) an image carrier which rotates while toner images are retained on it, (3) a transferring section to transfer toner images from the image carrier to a recording material and, (4) a cleaning section to remove remaining toner from the image carrier after transferring an image, wherein said cleaning section comprises a cleaning blade contacting said image carrier and a toner supplier which is installed on the upstream side of the rotation of the image carrier from the contacting point of the cleaning blade and supplies toner to said image carrier, wherein said toner supplier comprises a toner accumulating portion to accumulate removed toner and a roller member contacting said image carrier.

BRIEF DESCRIPTION OF THE DRAWINGS

FIGS. 7(*a*) and 7(*b*) are graphs showing a result of experiments comparing the present preferred embodiment (Condition A) with comparison condition (B).

FIG. 8 is a table showing the appropriate cleaning range when the weight of the cleaning blade and the contact pressure of the toner removal restriction-member are changed.

FIG. 9 is a schematic configuration diagram showing other preferred embodiments of the toner removal restriction member.

DETAILED DESCRIPTION OF THE PREFERRED EMBODIMENT

Figure 1:
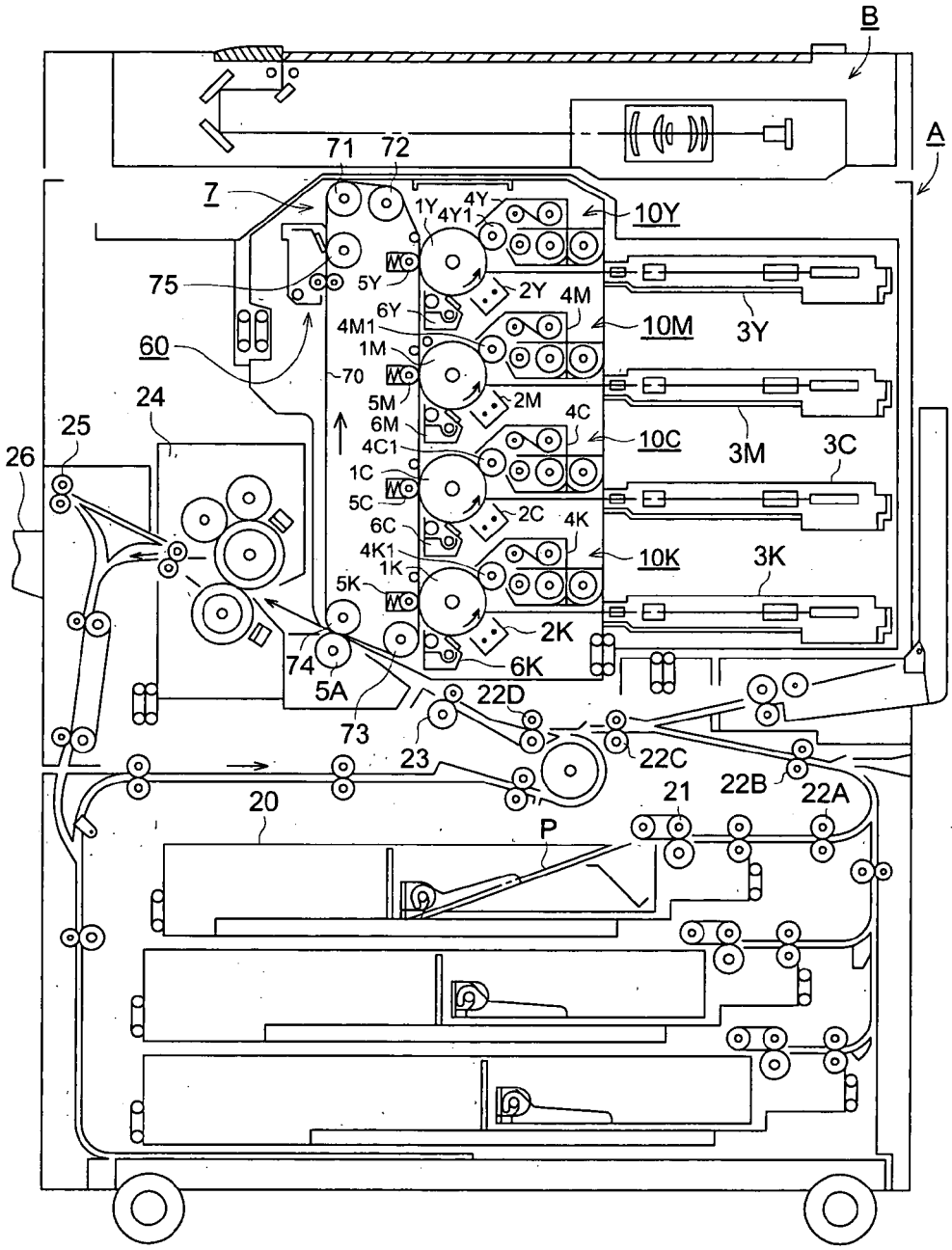
FIG. 1 is a schematic configuration diagram of a tandem type color image forming apparatus.

First, preferred configurations will be described as follows.

(1-1) A cleaning apparatus comprising a cleaning blade to remove remaining toner from an intermediate image transfer body after a toner image formed on an intermediate image transfer body is transferred onto a recording material secondarily and a toner supplying means which is located on the upstream side of the rotating direction of the intermediate image transfer body and supplies toner removed by said cleaning blade onto said intermediate image transfer body, wherein the toner quantity to be supplied to said intermediate image transfer body by said toner supplying means is greater than or equal to 0.2 mg/cm$^2$ and less than or equal to 0.6 mg/cm$^2$.

It is preferable that the quantity of toner which said toner supplier supplies to said image carrier is 0.2 mg/cm$^2$ through 1.5 mg/cm$^2$.

(1-2) An image forming apparatus comprising a cleaning blade which removes remaining toner from said intermediate image transfer body after a secondary image transfer onto a recording material in the image forming apparatus wherein a toner image formed on an image carrier is transferred onto a intermediate image transfer body as a primary image transfer and the toner image on the intermediate image transfer body is further transferred onto a recording material as a secondary image transfer for image formation, a toner supplying means which is located on the upstream side of the rotating direction of said intermediate image transfer body and supplies toner removed by said cleaning blade onto said intermediate image transfer body and a storing means to store a band image, wherein a band image stored in said storing means is formed to be a toner image on said intermediate image transfer body at every prescribed traveling distance of the intermediate image transfer body.

(1-3) An image forming apparatus which transfers a toner image formed on an image carrier onto a intermediate image transfer body as a primary image transfer and further transfers the transferred toner image on the intermediate image transfer body onto a recording material as a secondary image transfer for image formation comprising a cleaning blade removing remaining toner from said intermediate image transfer body after the secondary image transfer onto a recording material, a toner supplying means which is located on the upstream side of the rotation of said intermediate image transfer body and supplies toner removed by said cleaning blade onto said intermediate image transfer body, a detecting means detecting the quantity of said remaining toner and a storing means storing a band image, wherein when said detecting means detects that the quantity of toner is less than or equal to 0.2 mg/cm$^2$$_1$ the band image stored in said storing means is formed as a toner image on said intermediate image transfer body.

In a cleaning apparatus and an image forming apparatus of this invention, even when successive copying of originals with low printing ratios or successive feeding of sheets with small width is carried out, bending of the cleaning blade and damage of the edge can be prevented, and further slipping of toner through the blade and toner filming can also be prevented to obtain a good image without white striations for a long period, by means of supplying an appropriate quantity of toner to a clearance between the edge of the cleaning blade and the intermediate image transfer body.

(2-1) An image forming apparatus with the feature that, in an image forming apparatus comprising a cleaning means for removing the toner remaining on the image carrier, said cleaning means has a cleaning blade that is in pressure contact with said image carrier, and, when viewed in the direction of rotation of said image carrier, toner guide members that are in contact with said image carrier at a position on the upstream side compared to the pressure contact position of said cleaning blade, and toner discharge restricting members that are in contact with said toner guide members.

(2-2) An image forming apparatus according to (2-1) above with the feature that the quantity of toner accumulated in the space formed by said cleaning blade, said toner guide members, said toner discharge restricting members, and said image carrier is maintained constant due to said toner discharge restricting members.

(2-3) An image forming apparatus according to (2-1) or to (2-2) above with the feature that the contacting pressure of said toner discharge restricting members pressing against said toner guide members is, as viewed from the direction of rotation of said image carrier, stronger at both ends than at the central part.

(2-4) An image forming apparatus according to any one of (2-1) to (2-3) above with the feature that the lengths of said cleaning blade, said toner guide members, and said toner discharge restricting member are such that, length of cleaning-blade>length of toner guide member≧length of toner discharge restricting member.

(2-5) An image forming apparatus according to any one of (2-1) to (2-4) above with the feature that said toner guide member is a sponge roller, which rotates in the same direction as said image carrier at the position of its contact with said image carrier, and also, the peripheral speed of said sponge roller is greater than the peripheral speed of said image carrier.

According to the configuration of (2-1) above, by forming a space for accumulating the toner removed by the cleaning blade using said image carrier, cleaning blade, toner guide members, and toner discharge restricting members, it is possible to supply at all times toner to the pressure contact part between the cleaning blade and the image carrier thereby providing lubrication to the cleaning blade. As a consequence of this, it is possible to solve the problems of bending of the cleaning blade, damage to the cleaning blade edge, toner filming, and pitch variations of the image, etc.

At the same time, it is possible to prevent reductions in the productivity and to avoid wasteful consumption of the toner without being affected by the printing width or the printing ratio.

According to the configuration of (2-2), in addition to the effect of (2-1), since a constant quantity of toner gets accumulated in said space due to said toner discharge restricting members, it is possible to provide sufficient lubrication to said cleaning blade, and there is no possibility of there being no toner in said space even when, for example, successive image formation is made with the print ratio being low. In addition, when successive image formation is made with the print ratio being high, it is possible to prevent the toner retained in said space from becoming packed or from slipping through the cleaning blade.

According to the configuration of (2-3), in addition to the effects of (2-1) or (2-2), the contact pressure of the toner discharge restricting members against the toner guide members is made, as viewed from the direction of rotation of said image carrier, stronger at both ends than at the central part, as a result of which damage to the cleaning blade over its entire length can be prevented because more toner will be accumulated at the two ends even when there are small quantities of toner to be removed at the two ends because of making successive image formations with narrow print widths.

According to the configuration of (2-4), in addition to the effects of any one of (2-1), (2-2), and (2-3), by having a configuration in which the lengths of said cleaning blade, said toner guide members, and said toner discharge restricting member are such that, length of cleaning blade>length of toner guide member>length of toner discharge restricting member, as seen from the direction of rotation of the image carrier, it is possible to prevent toner from getting blown around and to prevent toner contamination because the removed toner falls directly at locations in the neighborhood of the two ends of said image carrier.

According to the configuration of (2-5), in addition to the effects of any one of (2-1), (2-2), (2-3), and (2-4), by having a configuration in which the toner guide member is a sponge roller that rotates in the same direction as said image carrier, with also the peripheral speed of the sponge roller having been made faster than the peripheral speed of said image carrier, it becomes possible to set appropriately the friction force between said sponge roller and said image carrier, and thus having the effect of lapping and polishing the surface of the image carrier by the sponge roller using the toner as the lapping and polishing medium without scratching the surface of the image carrier, thereby preventing the toner from getting bonded to the surface of the image carrier, that is, to prevent the toner filming phenomenon from occurring.

(3-1) An image forming apparatus with the feature that, in an image forming apparatus comprising an image forming means that forms images on the image carrier and a cleaning means that removes the toner remaining on said image carrier, the configuration is such that said cleaning means has a cleaning blade that is in pressure contact with said image carrier, toner guide members that are in contact with said image carrier at a position on the upstream side compared to the pressure contact position of said cleaning blade when viewed in the direction of rotation of said image carrier, and toner discharge restricting members that are in contact with said toner guide members, with a space formed that is surrounded by said cleaning blade, said toner guide members, said toner discharge restricting members, and said image carrier, and a detection means is provided for detecting the quantity of toner accumulated in said space, and a control means is provided for carrying out control so that a toner image is formed on said image carrier and said toner image is supplied to said cleaning means when it is judged by said detection means that the quantity of toner accumulated in said space is small.

(3-2) An image forming apparatus with the feature that, in an image forming apparatus comprising an image forming means that forms images on the image carrier and a cleaning means that removes the toner remaining on said image carrier, the configuration is such that said cleaning means has a cleaning blade that is in pressure contact with said image carrier, toner guide members that are in contact with said image carrier at a position on the upstream side compared to the pressure contact position of said cleaning blade when viewed in the direction of rotation of said image carrier, and toner discharge restricting members that are in contact with said toner guide members, with a space formed that is surrounded by said cleaning blade, said toner guide members, said toner discharge restricting members, and said image carrier, and plural detection means are provided for detecting the quantity of toner accumulated in said space, and a control means is provided for carrying out control so that, when it is judged by any one of said detection means that the quantity of toner accumulated in said space is small, a toner image is formed at a location on said image carrier corresponding to the specific detection means and said toner image is supplied to said cleaning means.

(3-3) An image forming apparatus with the feature that, in an image forming apparatus comprising a cleaning means that removes the toner remaining on the image carrier, the configuration is such that said cleaning means has a cleaning blade that is in pressure contact with said image carrier, toner guide members that are in contact with said image carrier at a position on the upstream side compared to the pressure contact position of said cleaning blade with said image carrier when viewed in the direction of rotation of said image carrier, and toner discharge restricting members that are free to be contact with or to be separated from said toner guide members, and a space formed that is surrounded by said cleaning blade, said toner guide members, said toner discharge restricting members, and said image carrier; a detection means is provided for detecting the quantity of toner accumulated in said space, and a control means is provided for carrying out control so that, when it is judged by said detection means that the quantity of toner accumulated in said space is small, said toner discharge restricting members are made to come into contact with said toner guide members and so that said toner discharge restricting members are separated from said toner guide members when it is judged by said detection means that the quantity of toner accumulated in said space is large.

(3-4) An image forming apparatus with the feature that, in an image forming apparatus comprising a cleaning means that removes the toner remaining on the image carrier, the configuration is such that said cleaning means has a cleaning blade that is in pressure contact with said image carrier, toner guide members that are in contact with said image carrier at a position on the upstream side compared to the pressure contact position of said cleaning blade when viewed in the direction of rotation of said image carrier, and toner discharge restricting members that are separated into plural members in the direction of rotation of said image carrier and that are free to be contact with or to be separated from said toner guide members; and a space formed that is surrounded by said cleaning blade, said toner guide members, said toner discharge restricting members, and said image carrier; and plural detection means are provided corresponding to said plural toner discharge restricting member for detecting the quantity of toner accumulated in said space; and a control means is provided for carrying out control so that, when it is detected by any one of said detecting members that the quantity of toner accumulated in said space is small, the corresponding toner discharge restricting member is made to come into contact with said toner guide member and so that, when it is detected from any one of said detection means that the quantity of toner accumulated is large, said toner discharge restricting member corresponding to said detecting member is separated from said toner guide member.

(3-5) An image forming apparatus according to any one of (3-1) to (3-4) above with the feature that said detection means is at a location further on the upstream side than the position at which said cleaning blade comes into pressure contact with said image carrier.

(3-6) An image forming apparatus according to any one of (3-1) to (3-5) with the feature that said detection means is a piezoelectric device.

According to the configuration of (3-1) described above, in cases when the quantity of toner accumulated in the space described above decreases, such as when forming images with low printing ratios, since the detection means detects that the toner quantity has decreased, a toner image is formed based on the result of that detection, and said toner image is supplied to the cleaning means, toner is replenished into said space thereby making it possible to prevent problems such as bending of the cleaning blade, damage to the cleaning blade edge, toner filming, and pitch variations of the image, etc.

According to the configuration of (3-2) described above, in cases when the quantity of toner accumulated decreases in said space corresponding to areas where no image is formed, such as when forming images with small printing widths, since the detection means corresponding to that area among plural detection means detects the decrease in the toner quantity, a toner image is formed based on the result of that detection at the position in said image carrier corresponding to the area where the quantity of toner decreased, and since said toner image is supplied to the cleaning means, toner is replenished into said space corresponding to the area where the quantity of toner decreased, thereby making it possible to prevent the problems described above.

According to the configuration of (3-3) described above, in cases when the quantity of toner accumulated in said space decreases, such as when forming images with low printing ratios, it is possible to prevent the quantity of toner in said space from becoming low because the detection means detects that the toner quantity has decreased, and based on the result of that detection, said toner discharge restricting members are made to come into contact with said toner guide members, and, on the other hand, in cases when the quantity of toner accumulated in said space increases, such as when forming images with high printing ratios, it is possible to prevent the quantity of toner in said space from becoming large because the detection means detects that the toner quantity has increased, and based on the result of that detection, said toner discharge restricting members are separated from said toner guide members, and hence it is possible to maintain the quantity of toner in said space at an appropriate level and, consequently, to prevent the problems described above as well as to prevent the toner slipping through the toner blade caused by increase in the toner quantity.

According to the configuration of (3-4) described above, in cases when the quantity of toner accumulated decreases in regions of said space corresponding to areas where no image forming is made, such as when forming images with small printing widths, it is possible to prevent the quantity of toner in the specific part of said space from decreasing because the detection means among plural detection means corresponding to that specific part of said space detects that the toner quantity has decreased, and based on the result of that detection, the corresponding toner discharge restricting member is made to come into contact with said toner guide member, and, on the other hand, in cases when the quantity of toner accumulated in said space increases, such as when forming images with high printing ratios, it is possible to prevent the quantity of toner from increasing in the corresponding parts of said space because the detection means among plural detection means corresponding to that specific part of said space detects that the toner quantity has increased, and based on the result of that detection, the corresponding toner discharge restricting member is separated from said its corresponding guide member, and hence it is possible to maintain the quantity of toner in all specific parts of said space at an appropriate level and, consequently, to prevent the problems described above as well as to prevent the toner slipping through the toner blade caused by increase or decrease in the toner quantity.

According to the configuration of (3-5) described above, by providing said detection means at a position more towards the upstream side that the position of pressure contact of the cleaning blade with said image carrier, it is possible to supply toner always in a stable manner to the area where the cleaning blade comes into contact with said image carrier.

According to the configuration of (3-6) described above, by constituting the detection means by piezoelectric devices, it is possible to detect the level of toner accumulated in said space accurately, that is, to detect the quantity of toner accurately.

In the following, an example of a preferred embodiment of the image forming apparatus according to the present invention is described while referring to the figures.

Furthermore, the definitive descriptions in the following explanations of the preferred embodiment are merely intended to shown the best mode and are not in anyway construed to limit the definition of terms or the technological scope of the present invention.

Firstly, the outline configuration of the image forming apparatus is described using FIG. 1.

FIG. 1 shows the outline configuration of a tandem type color image forming apparatus.

This image forming apparatus is of the type called tandem type color image forming apparatus and comprises plural sets of image forming sections 10Y, 10M, 10C, and 10K, an endless belt shaped intermediate image transfer body unit 7, a paper transport means (no symbols assigned), and a fixing means 24. The document image reading apparatus B is placed on top of the body of the image forming apparatus A.

The image forming section 10Y that forms images of yellow color comprises the photosensitive body 1Y which is the first image carrier, the charging means 2Y that is placed on the periphery of said photosensitive body 1Y, the exposure means 3Y, the developing means 4Y, the primary transfer roller 5Y which is the primary transfer means, and the cleaning means 6Y, etc.

The image forming section 10M that forms images of magenta color comprises the photosensitive body 1M which is the first image carrier, the charging means 2M that is placed on the periphery of said photosensitive body 1M, the exposure means 3M, the developing means 4M, the primary transfer roller 5M which is the primary transfer means, and the cleaning means 6M, etc.

The image forming section 10C that forms images of cyan color comprises the photosensitive body 1C which is the first image carrier, the charging means 2C that is placed on the periphery of said photosensitive body 1C, the exposure means 3C, the developing means 4C, the primary transfer roller 5C which is the primary transfer means, and the cleaning means 6C, etc.

The image forming section 10K that forms images of black color comprises the photosensitive body 1K which is the first image carrier, the charging means 2K that is placed on the periphery of said photosensitive body 1K, the exposure means 3K, the developing means 4K, the primary transfer roller 5K which is the primary transfer means, and the cleaning means 6K, etc.

The developing means. 4Y, 4M, 4C, and 4K are provided with developing rollers 4Y1, 4M1, 4C1, and 4K1 which are toner carrier bodies that have a cylindrical shape with, for example, a thickness of 0.5 to 1 mm and external diameter of 15 to 25 mm, and that are made of non-magnetic stainless steel or aluminum, respectively containing dual component toner (single component toner can also be used) made of toners of the colors yellow (Y), magenta (M), cyan (C), or black (K) that have been charged with electricity of the same polarity as the charging polarity of the photosensitive bodies 1Y, 1M, 1C, and 1K.

The developing rollers 4Y1, 4M1, 4C1, and 4K1 are maintained at a specific spacing, for example, 100 to 1000 micrometers, from the respective photosensitive bodies 1Y, 1M, 1C, and 1K in a non-contacting manner by projecting rollers (not shown in the figure) and are made to rotate in the same direction as the direction of rotation of the photosensitive bodies 1Y, 1M, 1C, and 1K.

During development, a non-contacting reversal development is carried out of the electrostatic latent image of the photosensitive bodies 1Y, 1M, 1C, and 1K by applying a development bias voltage that is either a DC voltage or an AC voltage superimposed on a DC voltage to the developing rollers 4Y1, 4M1, 4C1, and 4K1 with the same polarity as that of the toners.

In general, a so-called external additive would have been added to the toners with the purpose of improving the flowability and the cleaning characteristics, and among these the lubricants that are related to the present invention are higher fatty acid salts of metals such as, for example, stearates of zinc, aluminum, copper, magnesium, calcium, etc., oleates of zinc, manganese, iron, copper, magnesium, etc., palmitates of zinc, copper, magnesium, calcium, etc., linoleates of zinc, calcium, etc., ricinoleates of zinc, calcium, etc.

The percentage of addition of these external additives is about 0.01% to 10% by weight relative to the toner.

The intermediate image transfer body unit 7 comprises plural rollers 71, 72, 73, 74, and 75, and the intermediate image transfer body 70 that is semi-conductive in nature and has the shape of an endless belt.

The intermediate image transfer body 70 is supported with tension due to external contact with the drive roller 73 that is coupled to the drive motor (not shown in the figure), the supporting rollers 71 and 72, the secondary transfer backup roller 74, and the backup roller 75, and the direction of rotation of the intermediate image transfer body 70 is arranged to be clockwise in FIG. 1.

The primary transfer rollers 5Y, 5M, 5C, and 5K for each color are provided opposite to the photosensitive bodies 1Y, 1M, 1C, and 1K via the intermediate image transfer body 70.

By applying a DC voltage with a polarity opposite to that of the polarity of the charge on the toner to the primary transfer rollers 5Y, 5M, 5C, and 5K thereby forming an image transfer electric field in the transfer region, the toner images of different colors formed on the photosensitive bodies 1Y, 1M, 1C, and 1K are transferred by a primary image transfer on to the intermediate image transfer body 70.

The secondary image transfer roller 74 is provided opposite to the secondary image transfer backup roller 5A via the intermediate image transfer body 70.

By applying a DC voltage with a polarity opposite to that of the polarity of the charge on the toner to the secondary image transfer roller 5A thereby forming an image transfer electric field in the transfer region, the superimposed toner images formed on the intermediate image transfer body 70 are transferred by a secondary image transfer on to the surface of the image transfer body 70 (the paper).

The paper P is supplied from the paper cassette 20 by the paper feed means 21, passes through plural intermediate rollers 22A, 22B, 22C, 22D and the registration roller 23, and is transported to the secondary image transfer position where the color image is transferred onto it in a single operation.

Further, when changing the size of the paper P, the configuration is such that the length along the direction at right angles to the direction of transportation (the paper width) is changed taking as reference the center of the intermediate image transfer body 70.

The paper P after the color image has been transferred onto it is subjected to fixing operation by the fixing means 24 and is placed on the ejected paper tray 26 after being squeezed between the paper ejection rollers 25.

A cleaning means 60 that removes the toner remaining on the intermediate image transfer body 70 is provided on the downstream side of the position of secondary image transfer as viewed from the direction of rotation of the intermediate image transfer body 70.

Further, the details of the cleaning means 60 will be described later in this document.

Here, explanation will be given about the materials of the intermediate image transfer belt and the image transfer roller in the present preferred embodiment of the present invention.

The intermediate image transfer body 70 is an endless belt with a volume resistivity of $10^6$~$10^{12}$ Ω·cm, and usually the material used for it is, for example, a resin material such as polycarbonate (PC), polyimide (PI), polyamideimide (PAI), polyvinylidenefluoride (PVDF), Ethylene-tetrafluoroethylene Copolymer (ETFE), or rubber materials such as EPDM, NBR, CR, polyurethane, etc., in which conductive filler such as carbon, etc., is dispersed or which contain ionic conductive materials, and the thickness of this belt should desirably be set at about 50 to 200 micrometers in the case of resin materials and at about 300 to 700 micrometers in the case of rubber materials.

The primary image transfer rollers 5Y, 5M, 5C, and 5K are formed, for example, by coating the peripheral surface of a conductive metal core (not shown in the figure) made of stainless steel etc., having an external diameter of about 8 mm with a covering of partially conducting rubber (not shown in the figure) having a thickness of 5 mm, rubber hardness of about 20° to 70° (Asker hardness), and being in the solid state or in the foam sponge state with a volume resistivity of about $10^5$ to $10^9$ Ω·cm and with the material of the coating being a rubber material-such as polyurethane, EPDM, silicone rubber, etc., in which conductive filler such as carbon has been dispersed or which contains an ionic conductive material.

The secondary image transfer roller 5A is formed, for example, by coating peripheral surface of a conductive metal core (not shown in the figure) made of stainless steel etc., having an external diameter of about 8 mm with covering of partially conducting rubber (not shown in the figure) having a thickness of 5 mm, rubber hardness of about 20° to 70°

(Asker —C), and having in the solid shape or the foam sponge state with a volume resistivity of about $10^5$ to $10^9$ Ω·cm with the material of the coating being a rubber material such as polyurethane, EPDM, silicone rubber, etc., in which conductive filler such as carbon has been dispersed or which contains an ionic conductive material.

Unlike the primary image transfer rollers 5Y, 5M, 5C, and 5K, since the secondary image transfer roller 5A comes into contact with the toner, it is common to use on its surface a coating of partially conductive fluorine-based resin or urethane resin, etc., that have superior mold separation characteristics. The secondary image transfer backup roller 74 is formed, for example, by the coating peripheral surface of a conductive metal core (not shown in the figure) made of stainless steel etc., with a covering of partially conducting rubber (not shown in the figure) such as polyurethane, EPDM, silicone rubber, etc., in which conductive filler such as carbon has been dispersed or which contains an ionic conductive material and whose thickness is in the range of 0.05 mm to 0.5 mm.

Next, the image forming process is explained based on FIG. 1.

When the image recording is started, the drive motor (not shown in the figure) of the photosensitive body 1Y starts due to which the photosensitive body 1Y of the yellow color (Y) image forming section 1Y is rotated in the counter-clockwise direction, and at the same time the electric potential of the photosensitive body 1Y starts to increase due to the charging action of the charging section 2Y.

After the charging of the photosensitive body 1Y is completed, writing of the image of the first color is started due to the electrical signal corresponding to the image data of Y, and a static electricity latent image of the Y image part of the document image is formed on the surface of the photosensitive body 1Y.

Said electrostatic latent image is reversal developed by the-developing roller 4Y1, either in the contacting or in the non-contacting state, and the yellow (Y) toner image is formed on the photosensitive body 1Y along with the rotation of the photosensitive body 1Y.

The toner image formed on the photosensitive body 1Y during the above image forming process is transferred onto the intermediate image transfer body 70 by the primary image transfer roller 5Y.

Subsequently, in synchronization with the toner image of Y on the intermediate image transfer body 70, the toner images of magenta (M), cyan (C), and black (K) are formed successively superimposing on the previously formed color image thereby yielding the color toner image.

After the image has been transferred, the toner remaining after transfer on the peripheral surfaces of the photosensitive bodies 1Y, 1M, 1C, and 1K are removed by the cleaning means 6Y, 6M, 6C, and 6K.

In synchronization with the formation of the color toner image on the intermediate image transfer body 70, the paper P which is separated and transported one sheet at a time is taken and transported via the resist roller 23 and the color toner image on the intermediate image transfer body 70 is transferred at once onto the paper P by the secondary image transfer roller 5A.

The electrostatic charge on the paper P onto which the color toner image has been transferred is discharged by the discharging means (not shown in the figure), and the paper is transported to the fixing apparatus 24, and after the toner has been fixed, the paper is ejected to the ejected paper tray 25 by the paper ejection rollers 25.

On the other hand, the toner remaining on the peripheral surface of the intermediate image transfer body 70 after the image transfer has been completed is removed by the cleaning means 60.

Although the image forming apparatus for which an explanation was given previously was a color image forming apparatus, a monochrome image forming apparatus can be included only if it has an intermediate image transfer body.

Next, an explanation will be given regarding cleaning section related to this invention.

The First Embodiment of the Cleaning Section

Figure 2:
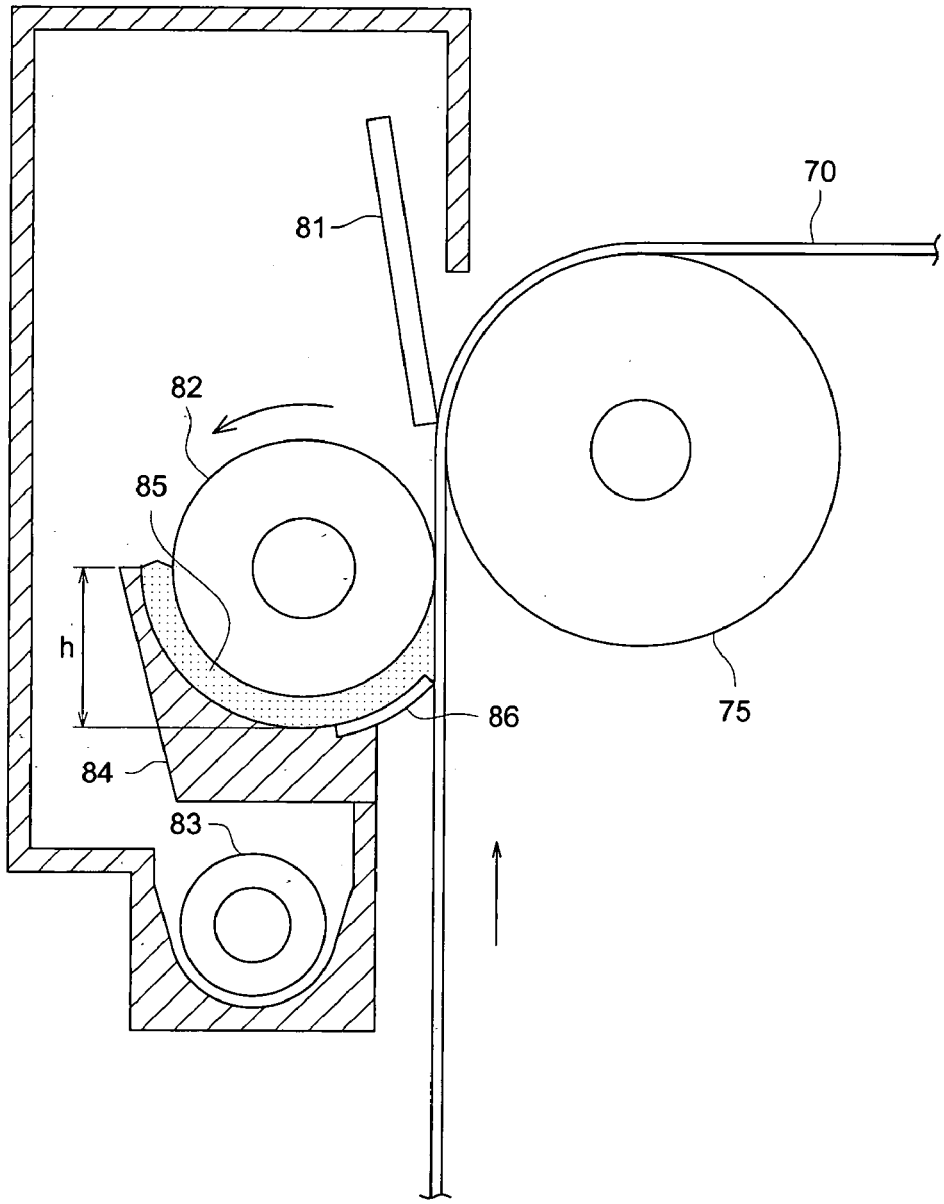
FIG. 2 is an enlarged diagram of a cleaning means.

FIG. 2 is an enlarged view of a cleaning section. The numeral 70 represents an aforementioned intermediate image transfer body and rotates in the direction indicated by the arrow while it winds around backup roller 71.

The numeral 81 represents a cleaning blade made of polyurethane rubber and so on, and slides on the circumference of intermediate image transfer body 70 in a direction counter to the direction of movement of intermediate image transfer body 70 from the upper side obliquely. After a secondary image transfer onto recording material P, remaining toner on intermediate image transfer body 70 is scraped off by the edge formed on the tip of cleaning blade 81. The numeral 82 represents a brash roller formed by electrically-conductive acrylic fiber so on, and rotates counter-clockwise by a driving source which is not illustrated. Brush roller 82 drops remaining toner scraped off by cleaning blade 81, into the left side of the roller. The fallen remaining toner is conveyed by conveying screw 83 and collected into a prescribed container.

Here, toner accumulating member 84 is fixed under brush roller 82 and toner accumulating portion 85 is formed between brush roller 82 and toner accumulating member 84 to accumulate a part of remaining toner scraped down by cleaning blade 81. The numeral 86 represents a polyurethane sheet sliding on intermediate image transfer body 7 to prevent remaining toner from falling from the right side of toner accumulating member 84.

As shown above, a part of remaining toner scraped down from intermediate image transfer body 70 by cleaning blade 81 is accumulated in toner accumulating portion 85 and is supplied toward the upper side by means of rotation of brush roller 82 while toner adheres to intermediate image transfer body 70, and though the toner is scraped off again by the edge of cleaning blade 81, a little amount of remaining toner keeps adhering to the edge of cleaning blade 81. Accordingly, the friction coefficient remains low between cleaning blade 81 and intermediate image transfer body 70, and even if copying with low printing ratios is carried out for a long period, blade bending or damage of the edge as well as white striations does not occur.

Next, an experiment was conducted regarding a relationship between the supplying quantity of remaining toner which is supplied upward by rotation of brush roller 82 while the remaining toner adheres to intermediate image transfer body 70 and the quantity of white striations occurring, and the result will be described below.

EXPERIMENT 1

(1) The Condition of the Experiment

Experimented apparatus: Tandem full-color copying machine

Photosensitive drum: 60 mm in diameter and coated with polycarbonate dispersed by phthalocyanine pigment as an organic semiconductor layer and the thickness of the photosensitive layer including a charge transport layer is 25 μm.

Voltage of photosensitive body non-imaging portion: Detected by a potential sensor, controlled by a feedback system and the controllable range is −500 V through —900 V.

Total exposing voltage: −50 V through 0 V

Exposure: Laser scanning system and the power of the semiconductor laser is 300 μW.

brush was changed, and further, the toner supplying quantity was changed 0.05 through 1.6 mg/cm$^2$ while rotating speed of brush roller 82 was changed. The quantity of toner was measured under the each condition in such a manner that the brush roller was rotated while toner was stored in the toner accumulating portion and the cleaning blade was separated from the intermediate image transfer body, and after toner adhering to the belt of intermediate image transfer body has passed through the position of the cleaning blade, the rotation of the belt of intermediate image transfer body was stopped to collect the toner adhering to the belt of intermediate image transfer body and the weight of the adhering toner was measured to determine the supplying quantity of toner. And then, by supplying toner of each supplying quantity, five A4-sized sheets were fed consecutively in the widthwise direction of the sheets to be color-copied and this action was repeated intermittently until the total number of the copied sheets reached 100,000. A character chart of 5% printing ratio for each color was used as an original.

(2) The Result of the Experiment

The result of the experiment is shown in Table 1.

TABLE 1

| | | Number of copied sheets | | | | | | | | | |
|---|---|---|---|---|---|---|---|---|---|---|---|
| | | 1 × 10$^4$ | 2 × 10$^4$ | 3 × 10$^4$ | 4 × 10$^4$ | 5 × 10$^4$ | 6 × 10$^4$ | 7 × 10$^4$ | 8 × 10$^4$ | 9 × 10$^4$ | 10 × 10$^4$ |
| Toner supply amount | 0.05 mg/cm$^2$ | B | C | C | C | C | C | C | C | C | C |
| | 0.1 mg/cm$^2$ | A | B | B | C | C | C | C | C | C | C |
| | 0.2 mg/cm$^2$ | A | A | A | A | A | A | A | A | A | A |
| | 0.3 mg/cm$^2$ | A | A | A | A | A | A | A | A | A | A |
| | 0.4 mg/cm$^2$ | A | A | A | A | A | A | A | A | A | A |
| | 0.5 mg/cm$^2$ | A | A | A | A | A | A | A | A | A | A |
| | 0.6 mg/cm$^2$ | A | A | A | A | A | A | A | A | A | A |
| | 0.8 mg/cm$^2$ | A | A | A | A | A | A | A | A | A | A |
| | 1.0 mg/cm$^2$ | A | A | A | A | A | A | A | A | A | A |
| | 1.2 mg/cm$^2$ | A | A | A | A | A | A | A | A | A | A |
| | 1.5 mg/cm$^2$ | A | A | A | A | A | A | A | A | A | A |
| | 1.6 mg/cm$^2$ | A | A | A | D | D | D | D | D | D | D |

Development: Dual component developing system

Intermediate image transfer body: Seamless semiconductive resin belt with rotating speed 220 mm/s, surface resistivity 1×10$^{11}$ Ω/□, volume resistivity 1×10$^8$ Ω·cm, tension 50 N.

Primary image transferring means: A primary image transfer roller (diameter 20 mm, resistance 1×10$^6$ Ω, roller pressure 5 N) is installed behind the intermediate image transfer body and a prescribed current selected from a current table of matrix created by data of temperature and humidity is applied.

Secondary image transferring means: An intermediate image transfer body is pinched by a backup roller and a secondary image transferring roller the both resistance of which are 1×10$^7$ Ω, and a prescribed current selected from a current table of matrix created by data of temperature and humidity is applied.

Cleaning blade for the intermediate image transfer body: Made of polyurethane rubber, free length 9 mm, thickness 2 mm and contacting angle 17 degrees.

Toner accumulating member: placed on the upstream side of the cleaning blade.

Brush roller: Made of electrically-conductive acrylic fiber, 6 through 15 denier, density 50,000 through 100,000 fibers/2.54 cm$^2$.

Under the above-stated conditions, the capacity of accumulating portion 85 was changed by changing height "h" of toner accumulating member 84, and also the kind of the After 10,000 copies had been made, an A3-sized original sheet which was halftone on a whole face was copied, and the occurring condition of white striations caused from toner filming was evaluated by A, B, C. Further, the white striations were observed visually and evaluated according to the following condition. Here, D indicates a cleaning defect.

A: No occurrence of white striations in the image

B: Less than or equal to 5 white striations in the image

C: Greater than or equal to 6 white striations in the image

As it can be known from the above result, maintaining the supplying quantity of toner to be greater than or equal to 0.2 mg/cm$^2$ brought a good result without occurrence of any white striations. On the other hand, the supplying quantity of toner greater than or equal to 1.6 mg/cm$^2$ caused a failure of toner leakage by slipping of toner under the cleaning blade in the cleaning section. Accordingly, it has been clarified that the preferable quantity of toner to be supplied to said image carrier by the toner supplying section is 0.2 mg/cm$^2$ through 1.5 mg/cm$^2$ and the quantity of 0.2 mg/cm$^2$ through 0.6 mg/cm$^2$ is much preferable.

EXPERIMENT 2

(1) The Condition of the Experiment

Under the same condition of Experiment 1, toner was previously accumulated in toner accumulating portion 85 before the experiment, a original sheet of 0% printing ratio for each color was copied.

(2) The Result of the Experiment

As the number of copied sheets increased, the supplying quantity of toner gradually reduced and the occurring condition of white striations caused from toner filming became C, after the number had reached 20,000.

Here, a band image was stored in memory 102 (storing means) and the band image was transferred to intermediate image transfer body 7 as a toner image at an every prescribed traveling distance of intermediate image transfer body 7 according to the following condition, and the secondary transfer was not carried out. The band image was formed to be 320 mm long in the main scanning direction (longer than the longer side of an A4-sized sheet and the maximum printing width) and to be 10 mm wide in sub-scanning direction. The band image included four colors of Y, M, C and K and the band image was formed so that the width of each color band was 2.5 mm in the sub-scanning direction.

EXPERIMENT "a"

B5-sized sheets were fed in the lengthwise direction (length 257 mm) and an original of 10% printing ratio for each color was used, and then a band image was formed whenever the traveling length of intermediate image transfer body 7 reached every 5 m.

As a result, no white striations appeared even after 100,000 sheets were copied. That is, when sheets having a small width less than 260 mm were used, there appeared parts to which no toner from the sheets adhered, on both ends of the cleaning blade edge. However, because of intermittent formation of a band image the width of which is wider than the width of sheets (maximum printing width), toner adheres even to the both ends of the cleaning blade edge and the friction coefficient between the cleaning blade and the intermediate image transfer body did not increase.

EXPERIMENT "b"

A4-sized sheets were fed in the lengthwise direction (length 297 mm) and a band image was formed whenever the traveling distance of intermediate image transfer body 7 reached every 20 m, on both conditions where an original of printing ratio of 0% for each color is used and where an original of printing ratio of 5% for each color is used.

Consequently, no white striations appeared even after 100,000 sheets were copied. That is, when an original sheet having a width larger than 260 mm and the printing ratio of which is less than %5 was used, toner adhering to cleaning blade edge gradually reduced and the friction coefficient between the cleaning blade and the intermediate image transfer body kept increasing. However, the increase of the friction coefficient could be avoided by forming intermittently a band image of the maximum printing size.

EXPERIMENT 3

(1) The Condition of the Experiment

Figure 3:
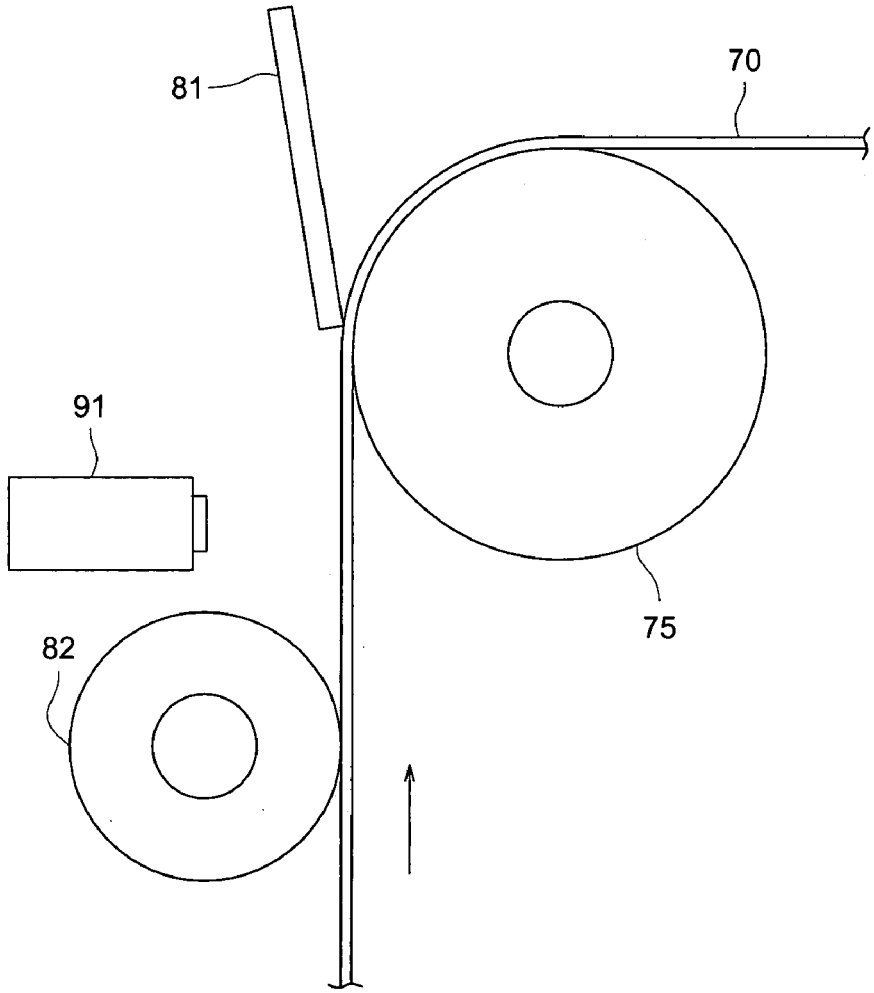
FIG. 3 is an enlarged diagram of a cleaning means equipped with optical sensor.

Under the same condition of Experiment 1, three photosensors 91 (detecting means) of diffuse reflection type were positioned between cleaning blade 81 and brush roller 82 on the widthwise direction of sheets (vicinity of the center and vicinity of the both ends) to detect the surface reflectance of intermediate image transfer body 7 adhered by toner as shown in FIG. 3. Consequently, when the quantity of toner reduced, the surface reflectance rose and the quantity of light received by photosensor 91 increased. When the quantity of toner became below 0.2 mg/cm$^2$, the output from photosensor 91 exceeded 2 V. Therefore, if output of any photosensors 91 exceeded 2 V, a toner band described above was formed.

Five A4-sized sheets were fed consecutively in the widthwise direction of the sheets to be color-copied and this action was repeated intermittently until the total number of the copied sheets reached 100,000. A character chart of 5% printing ratio for each color was used as an original.

(2) The Result of the Experiment

After every 10,000 copies, an A3-sized sheet which was halftone on whole surface was copied for evaluating the occurring condition of white striations caused from toner filming, and no white striations were observed.

The Second Embodiment of the Cleaning Section

Next, the details of the second embodiment of the cleaning section are explained using FIG. 2.

Figure 4:
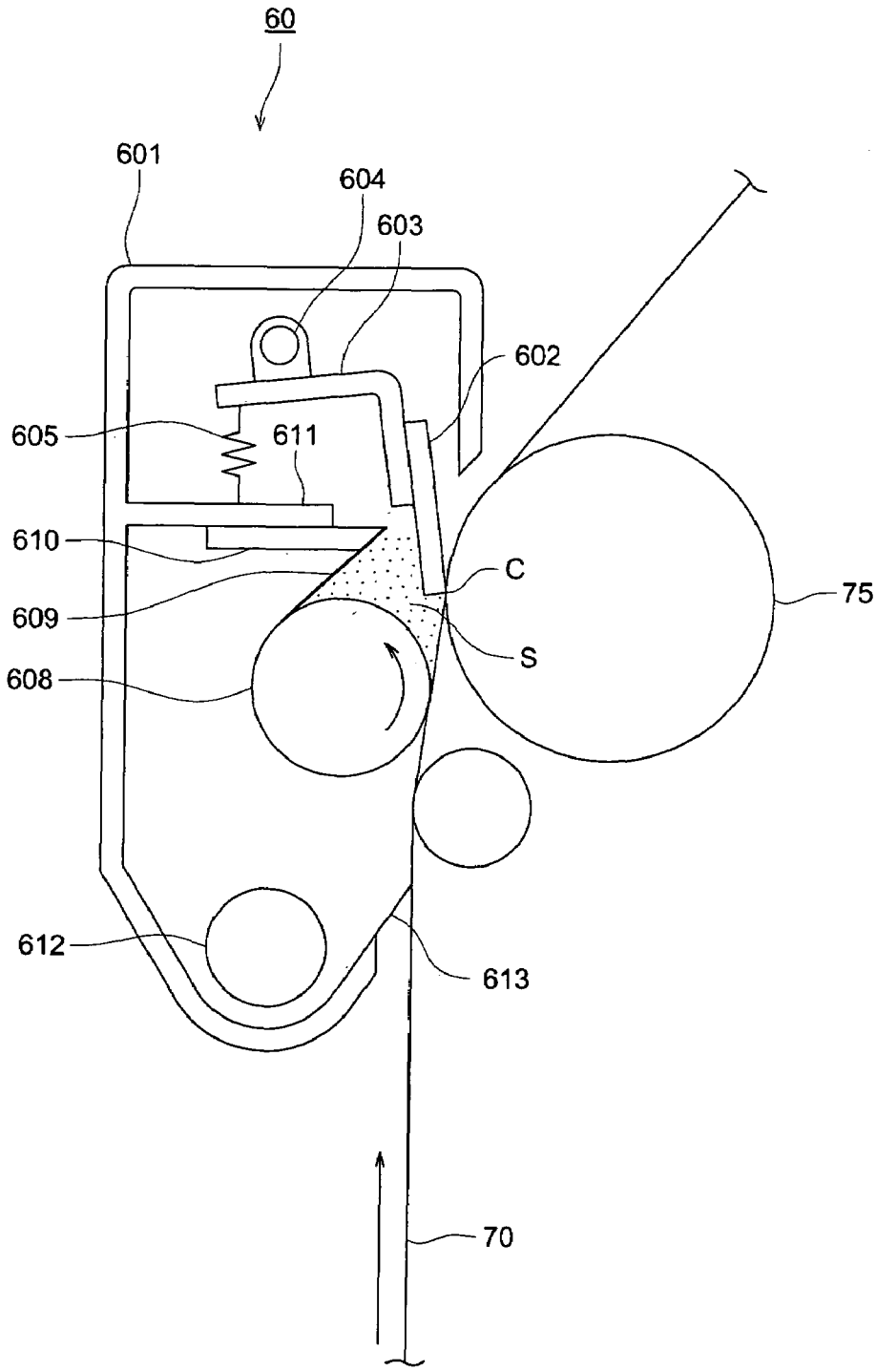
FIG. 4 is a cross-sectional drawing of the important parts of a cleaning means.

FIG. 4 is the cross-sectional diagram of the important parts of the cleaning means 60.

In the figure, 601 is the casing to which different members configuring the cleaning means 60 are affixed, and also has a container section for collecting the toner removed from the intermediate image transfer body 70.

602 is the cleaning blade made of an elastic material such as urethane rubber, etc., and has been fixed to the blade holder 603 by an adhesive, etc.

The blade holder 603 has been affixed to the supporting axle 604 that has been provided in the casing and around which the blade holder 603 is free to rotate. 605 is the pressing spring that acts so that the blade holder 603 is made to rotate in a counterclockwise direction around the supporting axle 604, and has been placed so that it pushes against and comes into contact at the pressure contact position C with the intermediate image transfer body 70 that has been backed up by the backup roller, with the tip of the cleaning blade 602 facing in a direction opposite to the direction of rotation of the intermediate image transfer body 70.

608 is the toner guide member which is a sponge roller, and when seen in the direction of rotation indicated by the arrow in the figure of the intermediate image transfer body 70, this sponge roller has been placed more on the upstream side than the position of pressure contact C between the cleaning blade 602 and the intermediate image transfer body 70, and so that it is in contact with the intermediate image transfer body 70.

The sponge roller 608 is rotated by a driving means (not shown in the figure) in the same direction as that of the intermediate image transfer body 70 at the position of its contact with the intermediate image transfer body 70, and also, the configuration is such that the peripheral speed of the sponge roller 608 is higher than the peripheral speed of the intermediate image transfer body 70.

609 is the toner discharge restricting member made of a PET sheet, one end of which is on the surface of the sponge roller 608 and contacts the sponge roller 608 on its side opposite to the point of contact between the sponge roller 608 and the intermediate image transfer roller 70, and the other end of the toner discharge restricting member is affixed using dual side adhesive tape to the sheet holding member 610 which is provided above the sponge roller 608.

The sheet holding member 610 is affixed to the projecting part 611 of the casing 601 by screws, etc.

Because of this configuration, the intermediate image transfer body 70, the cleaning blade 602, the sponge roller 608, and the toner discharge restricting member 609 form the space S.

612 is the discharge screw provided on the bottom of the casing 601, and transports the toner accumulated in the bottom part of the casing 601 in a direction perpendicular to the surface of the paper of the figure, and discharges the toner to outside the casing 601.

As is shown in the Figure, 613 is a toner receptacle sheet made of PET one end of which is adhered to the bottom part of the casing 601 opposite to the intermediate image transfer member 70, and the other end of which is in light contact with the intermediate image transfer body 70, and this sheet prevents the toner inside the casing from dropping down.

The operation of the cleaning means 60 with the above configuration is described in the following paragraphs.

After the toner image on the intermediate image transfer body 70 is transferred onto the paper at the secondary image transfer position, the toner remaining on the intermediate transfer body 70 is accumulated in the space S described above.

When the quantity of the toner accumulated in the space S exceeds a specific-value, the toner will be discharged from the location of contact between the toner discharge restricting member 609 and the sponge roller 608 thereby maintaining the quantity of toner accumulated at a constant value.

In other words, when the quantity of toner accumulated in the space S increases, since the toner discharge restricting member 609 is made of a PET sheet with elastic nature, it naturally functions as a pressure adjusting valve, and hence acts in such a manner as to maintain the quantity of toner in the space S at a constant value.

Therefore, by configuring so that the top level of the accumulated toner is always above the position C of pressure contact, even if image formation of successive images with low printing ratios continues, toner will be supplied to the front edge of the cleaning blade 602 as the lubricant.

Further, even when successive image formation continues in the state in which the length of the paper in a direction at right angles to the direction of rotation of the intermediate image transfer body, that is, to the direction of transportation of paper (the paper width, or also referred to as the printing width) is short, since the toner has fluidity, and since the toner spreads in the width direction of the-paper and gets uniformly accumulated in the space S due to the rotational movement of the sponge roller 608 and due to very small vibrations of the apparatus, etc., the toner will be spread out over the entire length of the cleaning blade as seen along the width direction of the paper.

Next, the details of the materials and constitution of the cleaning blade, the sponge roller, and the toner discharge restricting member in the present preferred embodiment are described below.

(1) Cleaning Blade
Material: Urethane
Hardness: 74° (JIS, A rubber hardness)
Load: 0.16 N/cm
Contacting angle: 17°
(2) Sponge Roller
Material: NBR (Acrylnitrylbutadiene rubber)
Hardness: 30° (Asker hardness C)
Peripheral speed: 1.2 times the peripheral speed of the intermediate image transfer body 70
(3) Toner Discharge Restricting Member
Material: PET
Thickness: 50 μm
Contacting pressure: 0.014 N/cm
Free length: 9 mm Here, the load on the cleaning blade is, as is shown in FIG. 5, the force (weight) P1 per unit length (cm) of the cleaning blade 602 that is generated at the pressure contact point C due to the action of the pressing spring 605 in a direction at right angles to the straight line connecting the center SC of the supporting axle 604 and the pressure contact point C.

Figure 5:
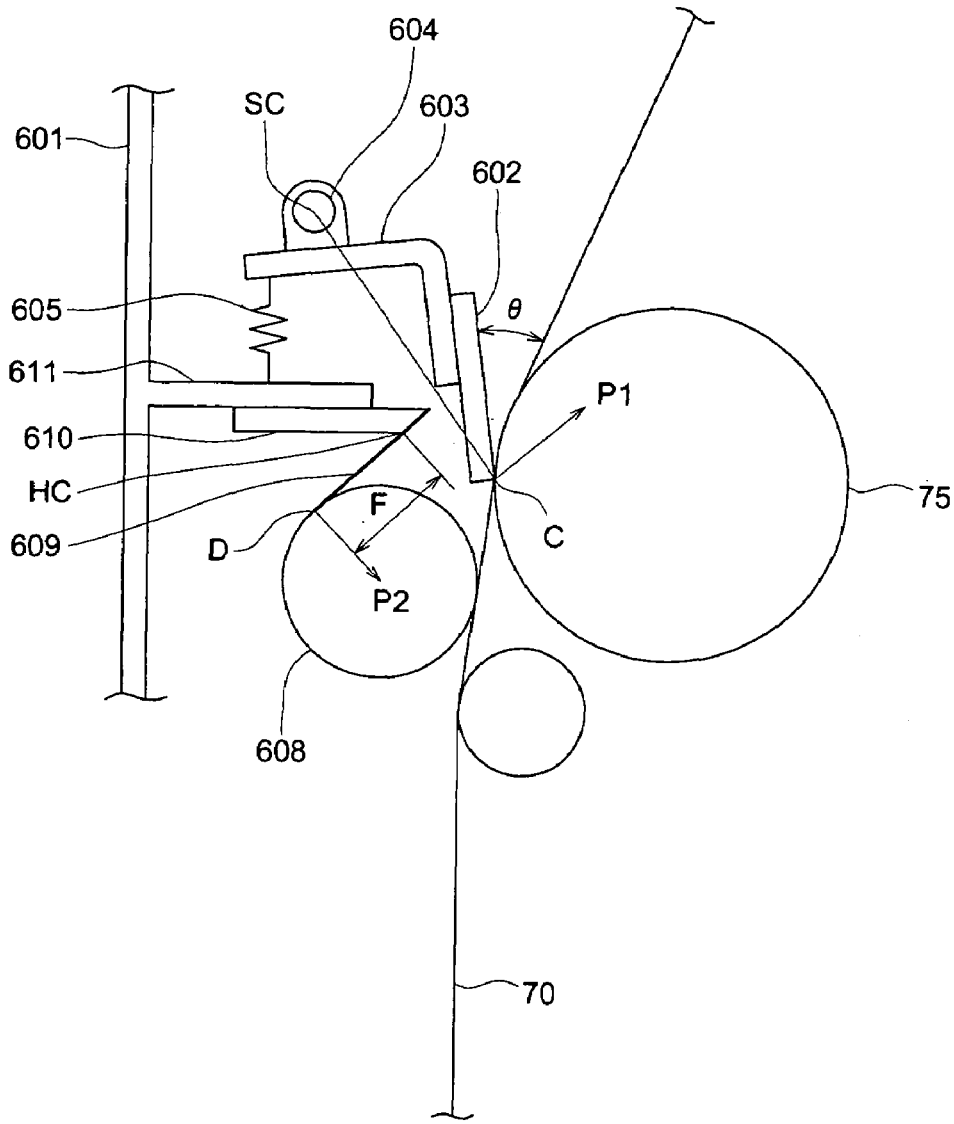
FIG. 5 is a cross-sectional drawing of parts in the neighborhood of a cleaning blade for explaining the weight of the cleaning blade and the contact pressure of toner discharge restricting members.

The contacting angle of the cleaning blade is the angle θ between the tangent at the circumference of the backup roller 75 and the cleaning blade 602 at the pressure contact point C in FIG. 5.

The contacting pressure of the toner discharge restricting member 609 is, similar to the load on the cleaning blade described above, the contacting force P2 per unit length (cm) of the toner discharge restricting member 609 (the contracting pressure) generated due to the elasticity of the toner discharge restricting member 609 at the position D of pressure contact between the toner discharge restricting member 609 and the sponge roller and at right angles to the straight line connecting the said pressure contacting point D and the contacting edge part HC between the toner discharge restricting member 609 and the sheet holding member 610.

The free length of the toner discharge restricting member 609 is, as is shown in FIG. 5, the length F of the toner discharge restricting member 609 from the contacting edge part HC and said contacting position D.

Figure 6:
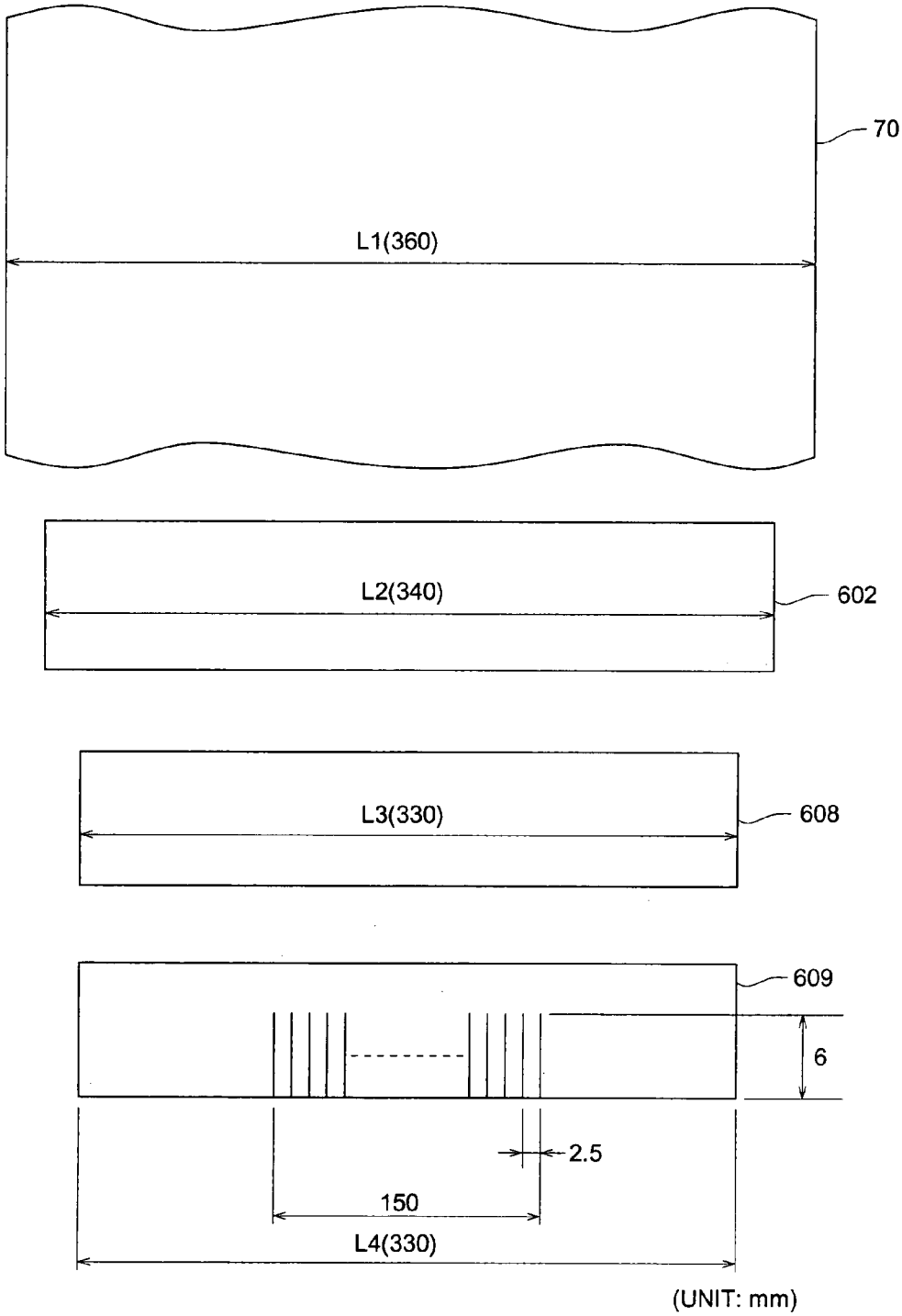
FIG. 6 is a figure for explaining the relationship among the lengths of the intermediate image transfer body, the cleaning blade, the sponge roller, and the toner discharge restricting members.

Furthermore, as is shown in FIG. 6, as seen along the paper width direction, the width L1 of the intermediate image transfer body 70 is 360 mm, the length L2 of the cleaning blade 602 is 340 mm, the length L3 of the sponge roller 608 is 330 mm, and the length L4 of the toner discharge restricting member 609 is also 330 mm, and the configuration is such that these lengths have a mutual relationship of L1>L2>L3=L4.

Further, the configuration is such that the width L3 of the sponge roller 608 is more than the maximum paper width.

In addition, as is shown in FIG. 6, as seen in the direction of the paper width, the toner discharge restricting member 609 has slits of depth 9 mm at a pitch of 2.5 mm at the central part of its width over a length of 150 mm.

By making such slits in the toner discharge restricting member, as seen in the direction of the paper width, the contacting pressure of the toner discharge restricting member 609 on the sponge roller 608 becomes stronger at the ends than at the central part of the member.

We carried out comparison experiments in order to confirm the effect of the present preferred embodiment (shall be considered as the Condition A) described above.

The points of difference between Condition B which was the reference for comparison and the Condition A were the following.

Toner guide roller: Brush roller
Toner discharge restricting member: Not present In addition, the environmental conditions were set at an ambient temperature of 30° C. and an ambient relative humidity of 80%, the paper size was A4, and image formation of a printing ratio of 1% was made on both sides of the paper for successive 5000 sheets of paper fed with the longer side parallel to the direction of paper transportation, and the results shown in FIG. 7 were obtained in this comparison experiment.

FIG. 7(*a*) shows how much was rate of damage to the part of the cleaning blade coming into pressure contact with the intermediate image transfer belt (the blade edge), that is, the ratio of the sum of the lengths of damaged locations in the blade edge to the overall length of the blade edge, as seen in the longitudinal direction of the cleaning blade, and this ratio was 2% in Condition A and 38% in Condition B.

The reason why the rate of damage is low in Condition A is that a constant quantity of toner is always accumulated in the space S, and hence toner is always present as the lubricant for the blade edge thereby preventing damage to the blade edge.

FIG. 7(*b*) is a table listing the evaluations of the edge damage near the center and near the two ends of the cleaning blade when seen in its longitudinal direction, and the toner filming near the center and near the two ends of the intermediate image transfer body as seen along the paper width direction.

The symbols used for indicating the evaluation are, a circle for absolutely no problem in actual use, a triangle and a cross together for some problems present in actual use, and two crosses for plenty of problems present in actual use.

As is also evident from the figure, compared to under Condition B, under Condition A there is no problem in both blade edge damage and toner filming, both near the center of the blade as well as near the two ends.

Regarding blade edge damage, this is because at all times there is a fixed quantity of toner accumulated in space S, and there was no blade edge damage even near the two ends because the contacting pressure of the toner discharge restricting body is larger near the two ends than near the center, and because sufficient quantity of toner is accumulated near the two ends of space S in spite of the paper width being very small.

Regarding toner filming, because the toner is retained on the surface of the sponge roller, and also, because of the difference in the peripheral speeds of the sponge roller and the intermediate image transfer body, the surface of the intermediate image transfer body will be polished by the toner retained on the surface thereby maintaining the clean condition.

Further, the generation of toner filming on the intermediate image transfer body was confirmed by the striation defects that appeared in the image on the paper and the status of toner adherence at the position on the surface of the intermediate image transfer belt corresponding to the striation defects.

Further, since the configuration has been set such that the width L1 of the intermediate image transfer body, the length L2 of the cleaning blade, the length L3 of the sponge roller, and the length L4 of the toner discharge restricting member have a mutual relationship of L1>L2>L3=L4, there was no spurting or spilling of the toner from both ends of the casing.

There is no spurting or spilling of the toner from both ends of the casing if L2>L3≧L4.

In addition, the temperature in the vicinity of the cleaning means was less than 55° C. and there was not lumping of the toner accumulated in the space.

Next, in the present preferred embodiment, we set the environmental conditions as an ambient temperature of 30° C. and a relative humidity of 80%, and verified the range over which the cleaning blade operates normally when the load on the cleaning blade and the contact pressure of the toner discharge restricting member are varied. The results of these tests are shown in FIG. 8.

The horizontal axis represents the load on the cleaning blade, and the vertical axis represents the contact pressure of the toner discharge restricting member.

As is shown in the figure, there was damage near the two ends of the cleaning blade and occurrence of toner filming when the contact pressure of the toner discharge restricting member was below the line L5 connecting the dark squares AA (0.06 N/cm).

The reason for this is that, since the contact pressure of the toner discharge restricting member on the sponge roller is too small, the toner removed by the cleaning blade gets discharged as the sponge roller rotates, and the specific quantity of toner will not be accumulated in said space S.

Further, cleaning defects of the toner slipping through the cleaning blade occurred above the line L6 that connects the dark diamond symbols BB.

The reason for this is that, since the pressure load of the toner discharge restricting member on the sponge roller is too large, the toner accumulated in said space S does not get discharged smoothly but the quantity accumulated becomes large thereby slipping through the cleaning blade.

As a result, the range enclosed between the straight lines L5 and L6 is the range in which there is damage to the edge of the cleaning blade, no toner filming on the intermediate image transfer body, and no occurrence of cleaning defects.

This range is sufficiently wide and it is possible to set appropriately the load on the cleaning blade and the contacting pressure of the toner discharge restricting member, and thus to obtain stable cleaning operation.

Further, in the present preferred embodiment, although the cleaning means was made to act on the intermediate image transfer body, the present invention need not be restricted to this configuration but can also be applied to the cleaning of a photosensitive body that transfers the toner image to the intermediate image transfer body, or to the cleaning of a photosensitive body that directly transfers the toner image to the transfer medium.

In the present preferred embodiment, although the toner guide was taken to be a sponge roller, it is sufficient if the toner guide can hold the toner removed by the cleaning blade without letting the toner fall down, and hence it is also possible to configure the apparatus so that the toner guide is, for example, a rubber roller, or a plastic roller, or the toner guide can also be made of a sheet material, etc.

In the present preferred embodiment, although the toner discharge restricting member was constituted by a PET sheet, it is sufficient if the toner discharge restricting member can form the space described above and also if it has the function of discharging the toner when the quantity of toner accumulated exceeds a certain value, and hence it is also possible to configure the apparatus so that, for example as is shown in FIG. 9, the toner discharge restricting member 609 is formed using a thin metal plate, the toner discharge restricting member 609 is held by the sheet holder member 610 in a free to rotate manner and presses like the pressure spring 620.

Next, other preferred embodiments of the cleaning means 60 are described below using FIG. 10 and FIG. 11.

Figure 10:
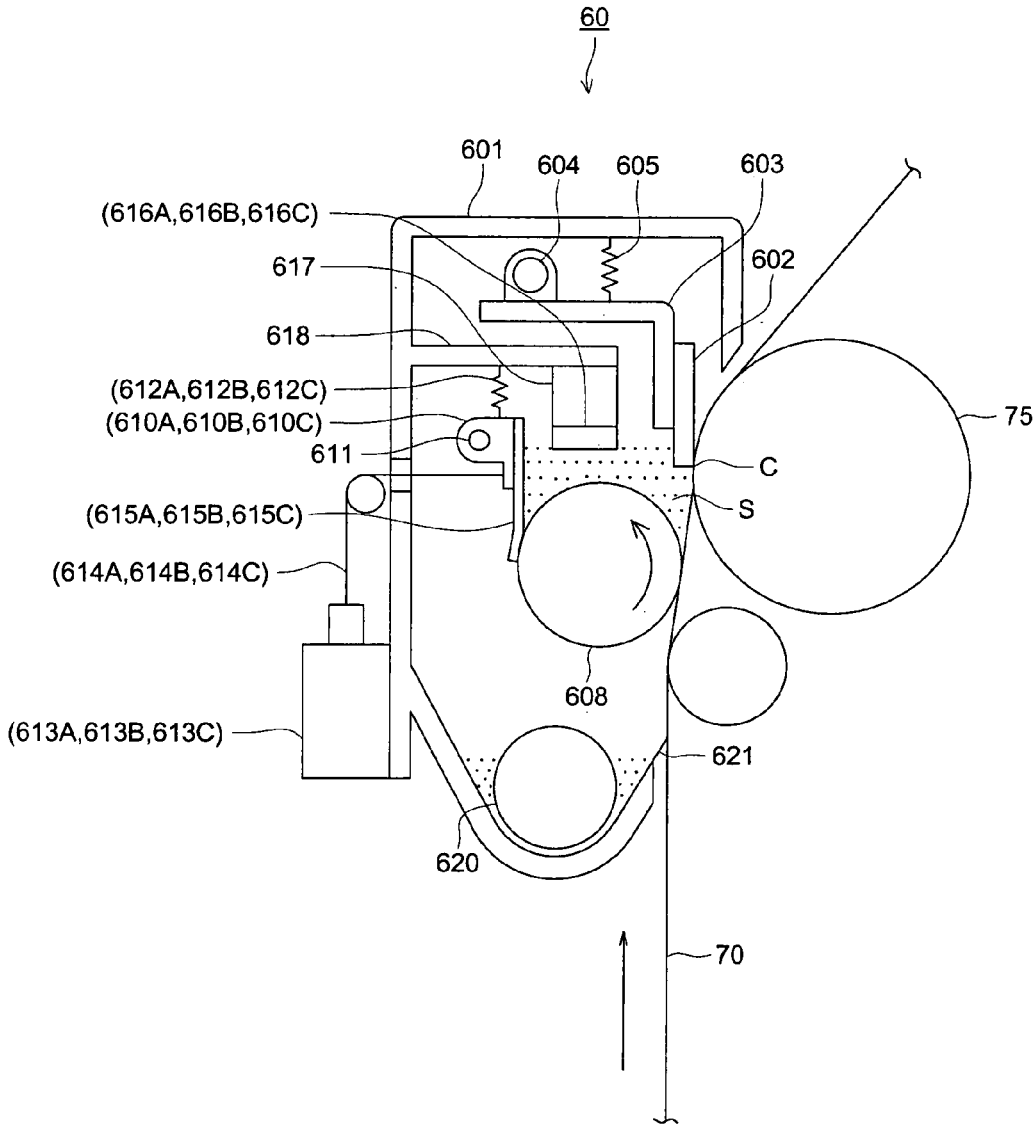
FIG. 10 is cross-sectional drawing of the important parts of a cleaning means.

FIG. 10 is a cross-sectional view drawing of the important parts of the cleaning means 60.

Figure 11:
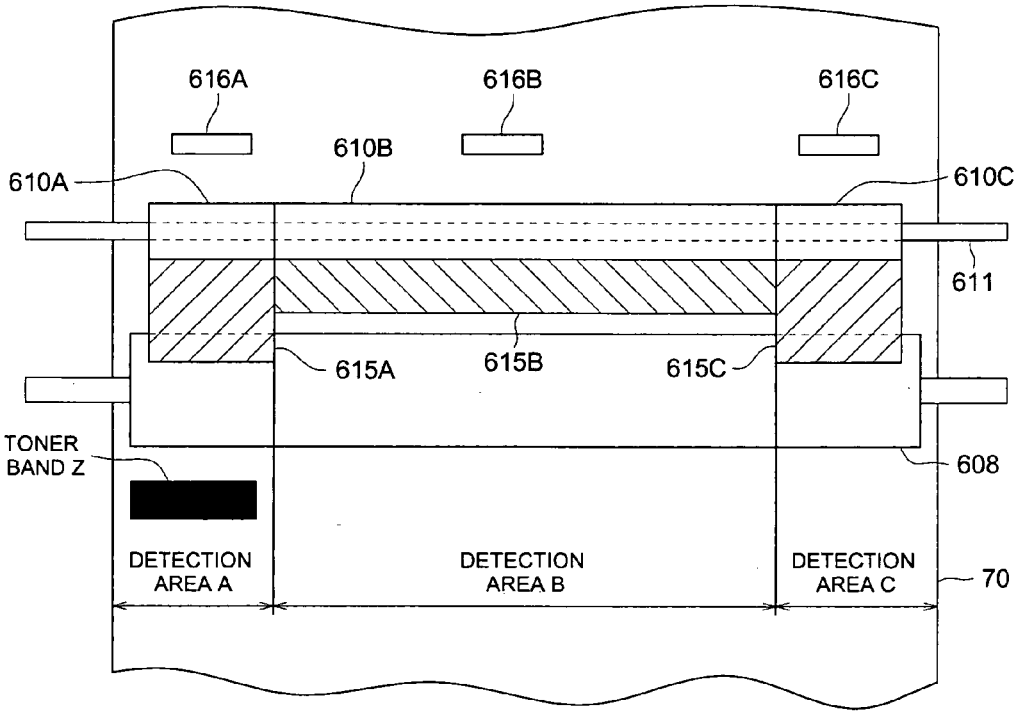
FIG. 11 is a schematic diagram showing the placement of plural detection means as seen from the direction of rotation of the intermediate image transfer body 70.

FIG. 11 is a schematic diagram-showing the placement of the plural detection means to be described later, as seen form the direction of the axis of rotation of the drive roller 73, etc., (see FIG. 1).

Here, 601 is the casing to which different members configuring the cleaning means 60 are affixed, and also has a container section for storing the toner removed from the intermediate image transfer body 70.

602 is the cleaning blade made of an elastic material such as urethane rubber, etc., and has been fixed to the blade holder 603 by an adhesive, etc.

The blade holder 603 has been affixed to the supporting axle 604 that has been provided in the casing and around which the blade holder 603 is free to rotate.

605 is the first pressing spring that acts so that the blade holder 603 is made to rotate in a counterclockwise direction around the first supporting axle 604. Because of this, the front edge of the cleaning blade 602 is in a condition in which it is facing in a direction opposite to the direction of rotation of the intermediate image transfer body 70 (counter direction) shown by an arrow in the figure, and pushes against and comes into contact at the pressure contact position C with the intermediate image transfer body 70 that has been backed up by the backup roller 75.

608 is the toner guide member which is a sponge roller, and when seen in the direction of rotation indicated by the arrow in the figure of the intermediate image transfer body 70, this sponge roller has been placed more on the upstream side than the position of pressure contact C between the cleaning blade 602 and the intermediate image transfer body 70, and so that it is in contact with the intermediate image transfer body 70.

The sponge roller 608 is rotated by a driving means (not shown in the figure) in the same direction as that of the intermediate image transfer body 70 at the position of its contact with the intermediate image transfer body 70, and also, the configuration is such that the peripheral speed of the sponge roller 608 is higher than the peripheral speed of the intermediate image transfer body 70.

610A, 610B, and 610C are sheet holding members that are above the-sponge roller 608 and are affixed in a free to rotate manner to the second supporting axle 611 that is affixed to the casing 601, and act in the counter-clockwise direction around the second supporting axle 611 due to the second pressure springs 612A, 612B, and 612C corresponding to the respective sheet holding members.

613A, 613B, and 613C are solenoids that are coupled to the corresponding sheet holding members 610A, 610B, and 610C via the wires 614A, 6514B, and 614C respectively.

When current is passed through the solenoids 613A, 613B, and 613C, the wires 614A, 614B, and 614C are pulled thereby making the sheet holding members 610A, 610B, and 610C rotate in the counter-clockwise direction around the second supporting axle 611.

Further, the current supplies to the above solenoids are made to each individual solenoid independent of the other solenoids.

615A, 615B, and 615C are the toner discharge restricting members made of PET sheet, one end of these members is affixed using dual side adhesive tapes to the corresponding sheet holding members 610A, 610B, and 610C, and, their other ends are in contact with the surface of the sponge roller 608, when there is no current passing through the solenoids 613A, 613B, and 613C, due to the action of the second pressure springs 612A, 612B, and 612C and contact the sponge roller 608 on its side opposite to the point of contact between the sponge roller 608 and the intermediate image transfer roller 70, but get separated from the surface of the sponge roller 608 when current is passed through-the solenoids 613.

Because of the configuration described above, the space S is formed that is enclosed by the intermediate image transfer body 70, the cleaning blade 602, the sponge roller 608, and the toner discharge restricting members 615A, 615B, and 615C.

616A, 616B, and 616C are detection means comprising piezoelectric devices that detect the level (height) of the toner accumulated in the space S, that is, the means that detect the quantity of toner, and are fixed via the sensor holder member 617 above the space S to the intermediate plate 618 formed in the casing 601.

As is shown in the figure, the detection means 616A, 616B, and 616C are placed higher than the pressure contact position C, and detect the upper level of the toner in the space S at a position higher than the pressure contact position C.

620 is the discharge screw provided on the bottom of the casing 601, and transports the toner accumulated in the bottom part of the casing 601 in a direction perpendicular to the surface of the paper of FIG. 10, and discharges the toner to outside the casing 601.

As is shown in FIG. 10, 621 is a toner receptacle sheet made of PET one end of which is adhered to the bottom part of the casing 601 opposite to the intermediate image transfer member 70, and the other end of which is in light contact with the intermediate image transfer body 70, and this sheet prevents the toner inside the casing from dropping down.

The lengths of the toner discharge restricting members as seen in the direction of rotation of the intermediate image transfer body 70, that is, in the direction of the paper width (printing width) and the detection means corresponding to them are described here with reference to FIG. 11.

The toner discharge restricting member 615B is placed at the central position above the intermediate image transfer body 70 and covers the detection area B having a width equal to the length of the shorter side of an A4 size paper sheet, and the toner discharge detecting members 615A and 615C correspond to the detection areas A and C, that cover a length equal to the maximum paper width (equal to the length of the longer side of an A4 size paper sheet) that can be handled in the present preferred embodiment minus the length of the shorter side of an A4 size paper sheet.

The detection means 616A, 616B, and 616C respectively correspond to the detection area A, detection area B, and the detection area C. For example, the detection means 616A monitors the toner level in the space S corresponding to the detection area A.

FIG. 11 shows schematically the two states, one is when it is judged that the quantity of toner in the space S corresponding to the detection area A is less than the specified value and the toner image Z (called the toner band) for supplying toner to the cleaning means is formed (created) on the intermediate image transfer body 70 in order to supply toner the corresponding area, and the other state is when it is judged that that the quantity of toner in the space S corresponding to the detection area B is more than the specified value and the toner discharge restricting member 615B is separated from the sponge roller 608 in order to discharge the excess toner from the area of the space S corresponding to this area.

Figure 12:
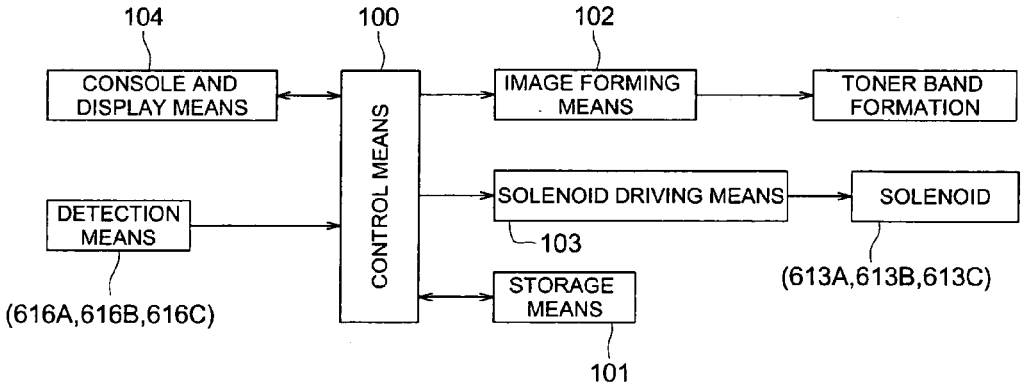
FIG. 12 is a block diagram of a control configuration diagram.

Next, the control configuration for creating a toner band on the intermediate image transfer body 70 and supply said toner band to the cleaning means is explained using the control configuration diagram shown in FIG. 12.

The control means 100 comprises a CPU that executes various types of control programs of the entire image forming apparatus, and controls the image forming means 102 based on the control data in the storage means 101 that comprises ROM and RAM, and based on the image data, and carries out normal image formation as well as the creation of the toner band described above.

Further, the control means 100 receives the detection signals from the detection means 616A, 616B, and 616C, and controls the solenoid drive means 103, and the solenoid drive means 103 in turn drives the solenoids 613A, 613B, and 613C.

Figure 13:
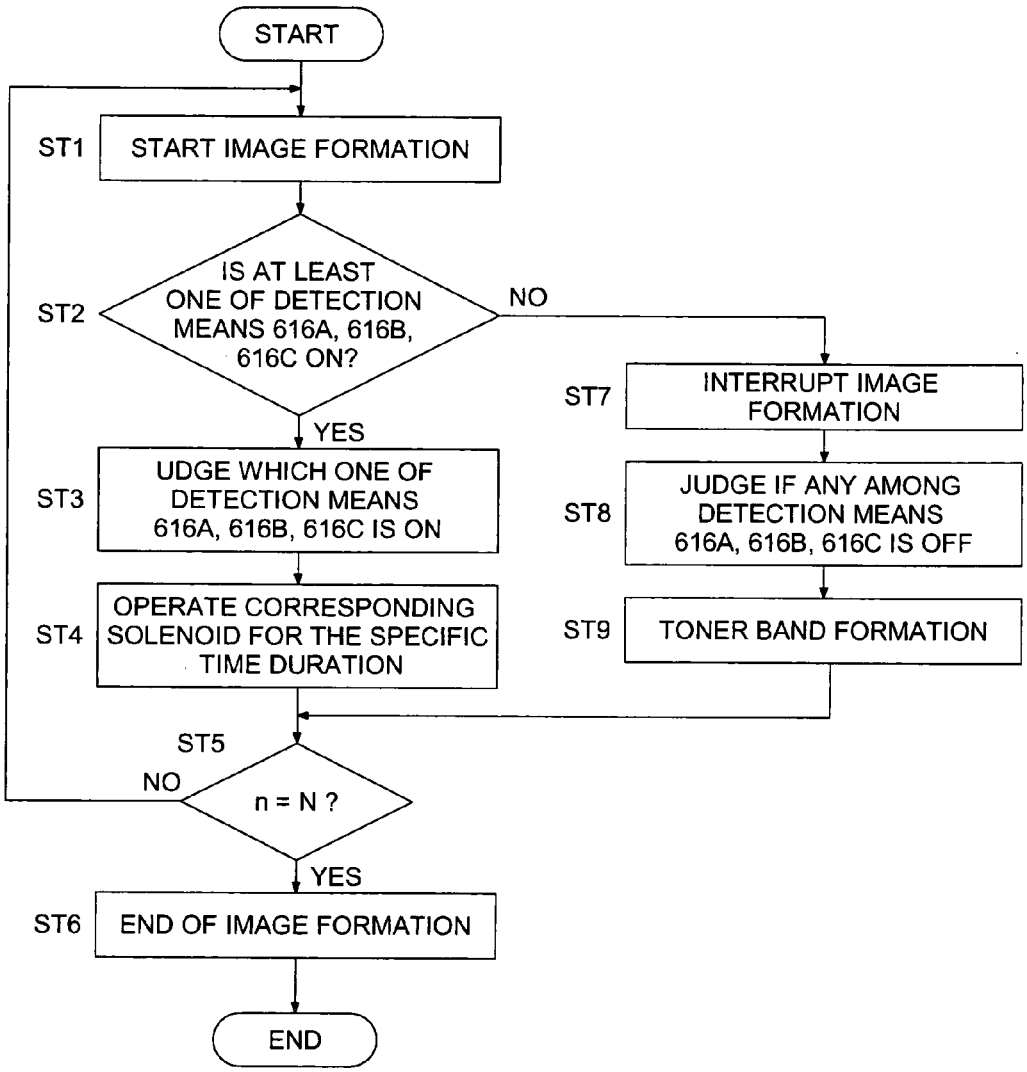
FIG. 13 is a flowchart showing the operating procedure of the cleaning means.

Next, the operating procedure of the cleaning means is explained while-referring to FIG. 13, and the procedure of forming the toner band is explained while referring to FIG. 10, FIG. 11, and FIG. 12.

FIG. 13 is a flow chart showing the operating procedure of the cleaning means.

The image formation count N is set using the console and display means, and the control means 100 starts forming the images (ST1).

Next, detection is made as to whether at least one of the detection means 616A, 616B, and 616C is ON, that is, if the toner accumulated in space S is being detected (ST2), if any one detection means is ON, the decision is made as to which one of the detection means 616A, 616B, and 616C is ON (ST3). Based on the result of this decision, the corresponding solenoid is operated for a specific time period (ST4) thereby discharging the excess toner accumulated in the space S.

Next, the decision is made of whether the number n of images formed has reached the set number N of images to be formed (ST5), if the set number has not been reached (the decision result is NO), the operation returns to ST1 thereby repeating image formation, and the image formation is terminated if the result of this decision is YES (ST6).

In ST2, if at least one of the detection means 616A, 616B, and 616C is OFF, the image formation is suspended (ST7), the decision is made as to which one of the detection means 616A, 616B, and 616C is OFF (ST8). Based on the result of this decision, toner bands are formed (ST9) on the area of the intermediate image transfer body 70 corresponding to the detection area covered by the specific detection means that is OFF, and thereafter, the operation proceeds to ST5 and the decision is made of whether the number n of images formed has reached the set number N of images to be formed (ST5). If the set number has not been reached (the decision result is NO), the operation returns to ST1 thereby repeating image formation, and the image formation is terminated if the result of this decision is YES (ST6).

Figure 14:
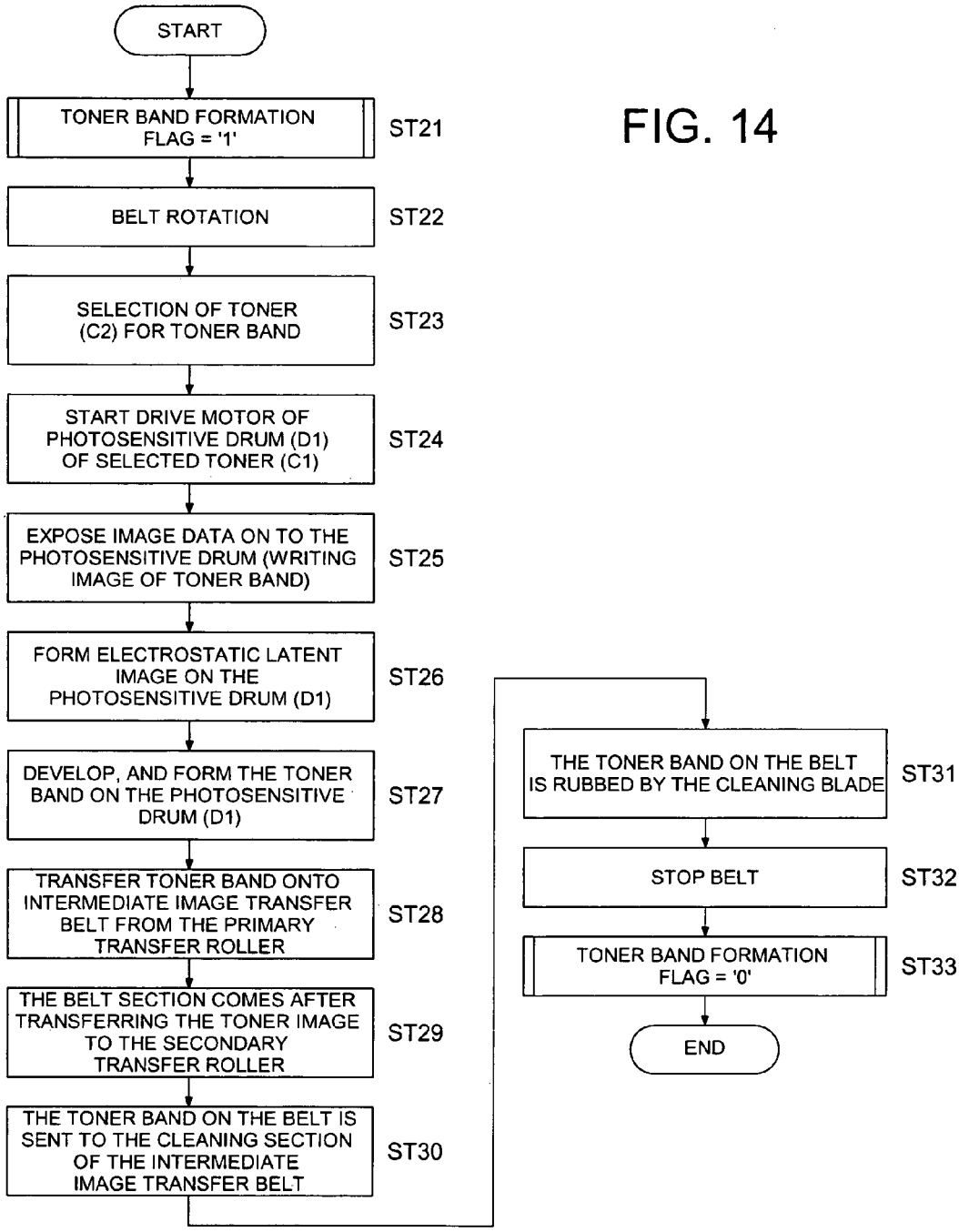
FIG. 14 is a flowchart showing the operating procedure of the toner band.

Next, the procedure of forming the toner bands in ST9 is described using the flow chart of the subroutine shown in FIG. 14.

When the decision to form toner bands is made, the toner band formation flag is set to '1' (ST21).

The rotation of the intermediate image transfer body 70 that had been stopped due to the suspension of image formation in ST7 of FIG. 13 is restarted (ST22).

Next, in ST23, the selection of the toner for the toner band is made.

The selection of the toner for the toner band out of the toners of the four colors is made based on the information about the different type of toners being used, since the availability of the toner dust dispersion prevention function or the rate of lubricant material addition differs depending on the type of the pigment material contained in the toner, it is possible to select beforehand the toner containing the maximum quantity of lubricant.

The drive motor (not shown in the figure) of the drum of the photosensitive body for the image formation of the selected toner is started (ST24), and the image data of the toner band that has been stored in the memory beforehand is exposed (writing the image) on the drum of the photosensitive body (ST25).

Next, in ST26, the electrostatic latent image of the toner band is formed on the drum of the photosensitive body, and in the development stage, toner is supplied to the surface of the drum of the photosensitive body from the developing means containing the toner that has been selected beforehand, and the latent image is made to appear as the toner band (ST27).

The materialized toner band is transferred onto the intermediate image transfer body 70 by the primary image transfer roller (ST28).

The toner band on the intermediate image transfer body 70 is sent to the secondary transfer roller section 5A (ST29).

In the secondary image transfer roller section 5A, since the signals prohibiting the application of image transfer voltage and the pressure contact of the belt would have been issued beforehand so that the transfer function does not operate, the toner band on the intermediate image transfer body 70 will not be transferred but will be sent as it is to the next process.

Subsequently, the toner band on the intermediate image transfer body 70 will be sent to the cleaning means 60 (ST30), and the toner band on the intermediate image transfer belt 70 will be rubbed by the cleaning blade 602 (ST31).

Toner will be added to the space S due to the toner band being rubbed by the cleaning blade 602.

After the toner band is rubbed by the cleaning blade 602, the intermediate image transfer body 70 stops at a specified position (ST32), the control goes into the wait state (SST33) after setting the toner band formation flag to '0'.

Further, the if the operating time of the solenoid during ST4 in FIG. 13 is too long, the quantity of toner accumulated in the space S becomes too small thereby causing the detection means to go OFF, it becomes necessary to suspend the normal image forming operation and to replenish the space S with toner. On the other hand, if this operating time is too short, and if the successive formation of images with high printing ratios continues, the quantity of toner accumulated in the space S increases excessively and hence the toner may not be removed by the cleaning blade but may slip through it. Therefore, while it is necessary to set the operating time of the solenoids to the optimum time period considering these factors, it is desirable to determine this optimum time period by experimentation.

In addition, when the successive formation of images with high printing ratios continues and the quantity of toner accumulated in the space S becomes excessively large, it is possible to have a configuration in which an upper limit detection means is provided for detecting when the upper limit on the quantity of toner has been reached, and when this detection means goes ON, the solenoids can be operated thereby forcibly discharging the toner.

Figure 15:
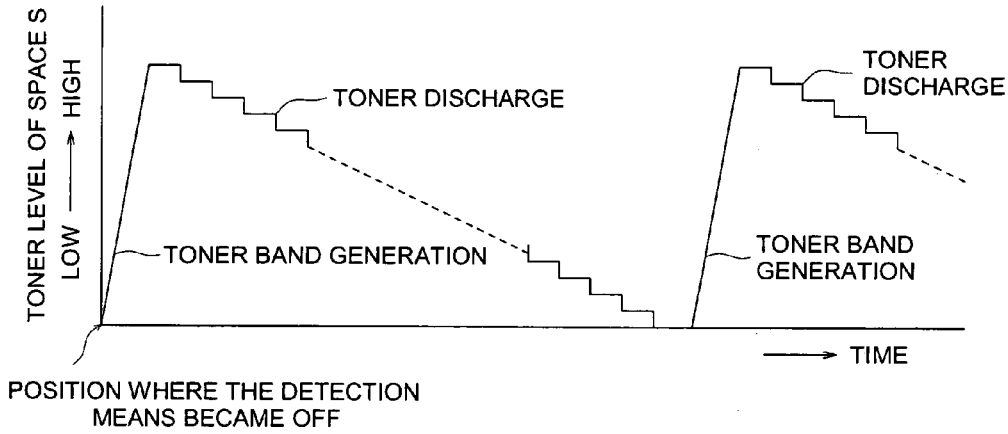
FIG. 15 is a diagram showing the toner band preparation and toner removal in the present preferred embodiment.

In the present preferred embodiment of the present invention, as is shown in FIG. 15, the image formation is suspended when at least one of the detection means 616A, 616B, and 616C is OFF, and toner band formation on the intermediate image transfer body is continued until the level of toner in the space S becomes higher than the top level of the toner at which the upper limit detection means becomes ON. After that, the solenoids are operated for a specific time interval thereby gradually decreasing the quantity of toner accumulated in the space S, and the toner band formation is started again when this detection means becomes OFF.

By repeating this type of operation cycles, the number of interruptions of normal image formation associated with the formation of toner bands is being made as small as possible.

Next, the details of the materials and constitution of the cleaning blade, the sponge roller, and the toner discharge restricting member in the present preferred embodiment are described below.

(1) Cleaning Blade
Material: Urethane
Hardness: 74° (JIS, AA rubber hardness)
Load: 0.16 N/cm
Contacting angle: 17°
(2) Sponge Roller
Material: NBR (Acrylnitrylbutadiene rubber)
Hardness: 30° (Asker hardness C)
Peripheral speed: 1.2 times the peripheral speed of the intermediate image transfer body 70
(3) Toner Discharge Restricting Member
Material: PET
Thickness: 0.2 mm
Contacting pressure: 0.03 N/cm
Free length: 9 mm Here, the load on the cleaning blade is, as is shown in FIG. 16, the force (weight) P1 per unit length (cm) of the cleaning blade 602 that is generated at the pressure contact point C due to the action of the first pressing spring 605 in a direction at right angles to the straight line connecting the center 5C of the first supporting axle 604 and the pressure contact point C.

The contacting angle of the cleaning blade is the angle θ between the tangent at the circumference of the backup roller 75 and the cleaning blade 602 at the pressure contact point C in FIG. 14.

The contacting pressures of the toner discharge restricting members 615A, 615B, and 615C are, similar to the load on the cleaning blade described above, the contacting force P2 per unit length (cm) of the toner discharge restricting members 615A, 615B, and 615C (the contracting pressure) generated by the toner discharge restricting members 615A, 615B, and 615C at the position D of pressure contact between the toner discharge restricting members 615A, 615B, and 615C and the sponge roller, this force being and at right angles to the straight line connecting the said pressure contacting point D and the contacting edge part HC between the toner discharge restricting members 615A, 615B, and 615C and the sheet holding members 610A, 610B, and 610C.

Figure 16:
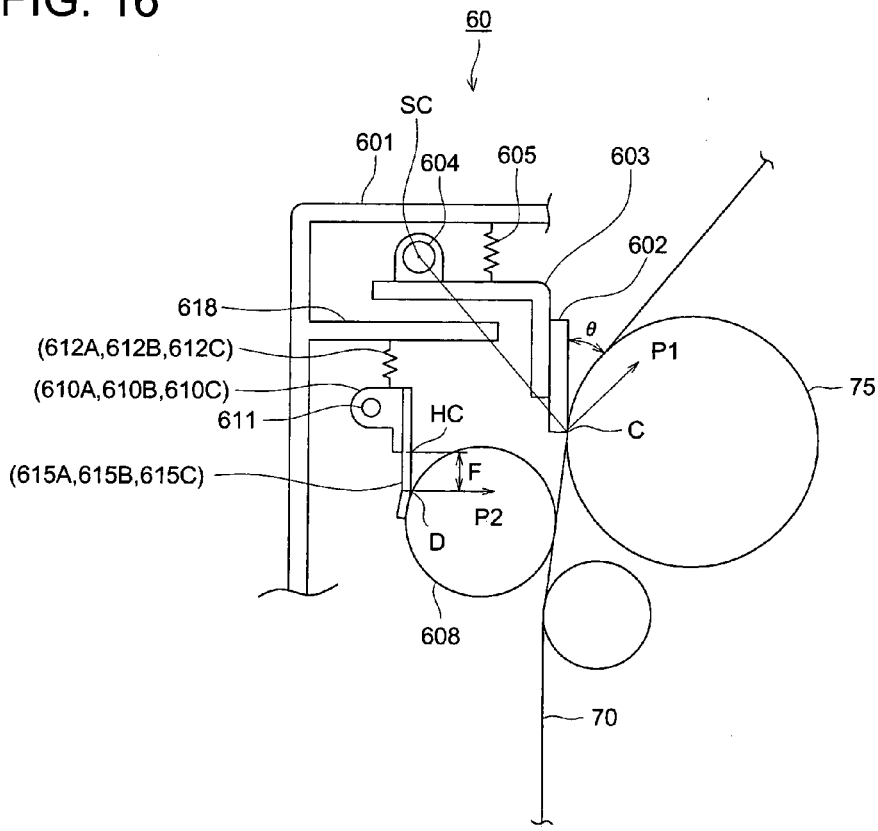
FIG. 16 is a cross-sectional drawing showing the important parts of the cleaning means for explaining the weight of the cleaning blade, contacting angle, and the contacting pressure of the toner discharge restricting members.

The free length of the toner discharge restricting member s615A, 615B, and 615C is, as is shown in FIG. 16, the length F from the contacting edge part HC and said contacting position D.

Figure 17:
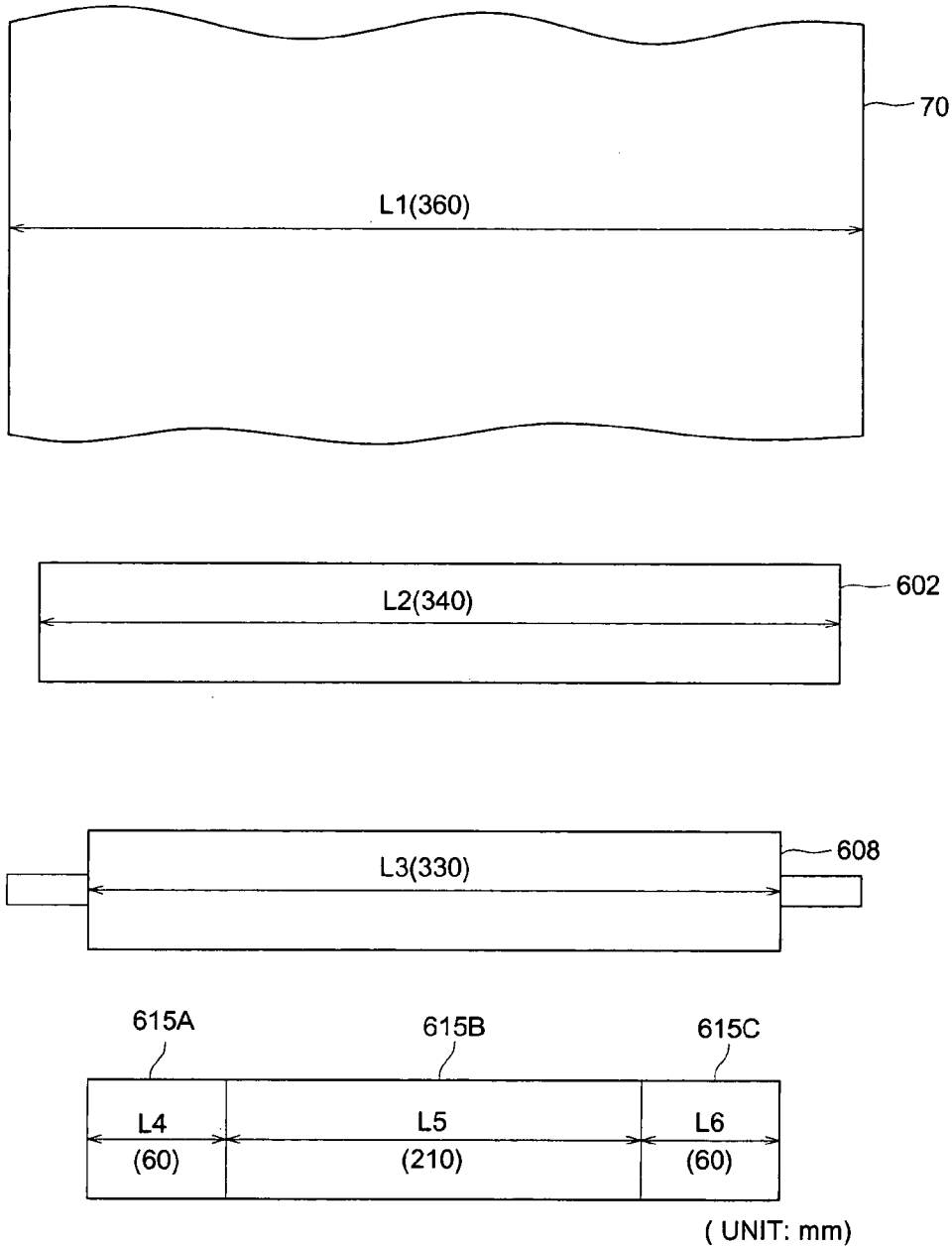
FIG. 17 is a schematic diagram showing the lengths of the intermediate image transfer body, the cleaning blade, the sponge roller, and of the toner discharge restricting member.

Furthermore, as is shown in FIG. 17, as seen along the paper width direction, the width L1 of the intermediate image transfer body 70 is 360 mm, the length L2 of the cleaning blade 602 is 340 mm, the length L3 of the sponge roller 608 is 330 mm, and the length L4 of the toner discharge restricting member 615A and the length L6 of the toner discharge restricting member 615C are both equal to 60 mm and the length L5 of the toner discharge restricting member 615B is 210 mm.

In this manner, by having a configuration such that these lengths have a mutual relationship of $L2>L3\geqq(L4+L5+L6)$, the leakage of toner from the casing 601 (Refer to FIG. 10) in the direction of the paper width has been prevented.

The comparison experiments carried out in order to confirm the effect of the present preferred embodiment described above are explained here.

The present preferred embodiment is taken as the Condition A and the configuration of the present preferred embodiment in which the toner discharge restricting members have been removed is taken as the Condition B.

COMPARISON EXPERIMENT—1

Figure 18:
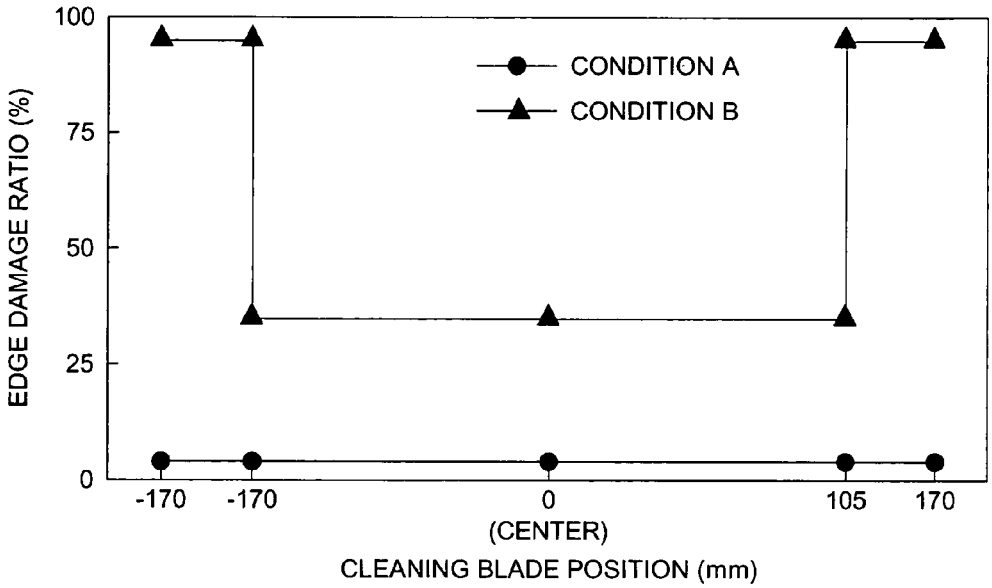
FIG. 18 is a graph showing the rate of edge damage in the comparison experiment-1.

The environmental conditions under which the comparison experiments were made were set at an ambient temperature of 33° C. and an ambient relative humidity of 85%, the paper size was A4, and image formation of a printing ratio of 1% was made on both sides of the paper for successive 5000 sheets of paper fed with the longer side parallel to the direction of paper transportation, and the results shown in FIG. 18 were obtained in this comparison experiment.

The horizontal axis in the figure represents the position along the cleaning blade in the paper width direction taking the center of the cleaning blade as 0.

The positions $10^5$ mm and $-10^5$ mm along the vertical axis correspond to the edges of an A4 size sheet of paper along its shorter side.

The vertical axis represents the rate of damage (edge damage ratio) of the edge part of the cleaning blade that comes into pressure contact with the intermediate image transfer body.

Figure 19:
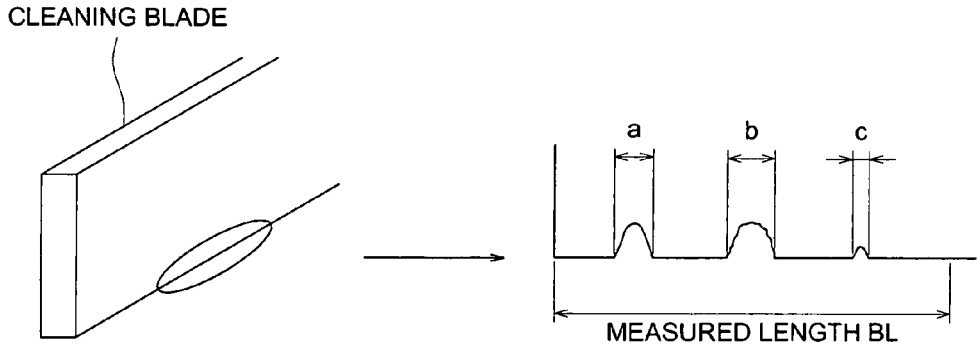
FIG. 19 is a diagram explaining the rate of edge damage.

The edge damage ratio (%) is, as is shown in FIG. 19, the ratio of the sum of the lengths of the parts damaged due to the edge part of the cleaning blade rubbing against the intermediate image transfer body (a+b+c) to the measured length BL of the cleaning blade.

As is evident from FIG. 18, under the conditions indicated by the symbol DD (Condition B), over the range (−105 mm to 105 mm) equivalent to the width of the paper, since the toner that has not been transferred is supplied to the cleaning blade, the damage ratio is low being about 35%, in the range outside the width of the paper, since there is no supply of toner to the cleaning blade, the damage ratio has become about 98%, and in particular, the damage to the cleaning blade is large in the range outside the paper width.

In contrast with this, under the conditions indicated by the symbol CC (Condition A), there was no damage to the edge part over the entire range because the detection means monitors the toner accumulated in the space S, and because, based on the result of that monitoring the control is carried out so that the quantity of toner accumulated in the space S is maintained at an appropriate value, toner is supplied at all times to the cleaning blade thereby providing lubrication to it.

COMPARISON EXPERIMENT—2

Figure 20:
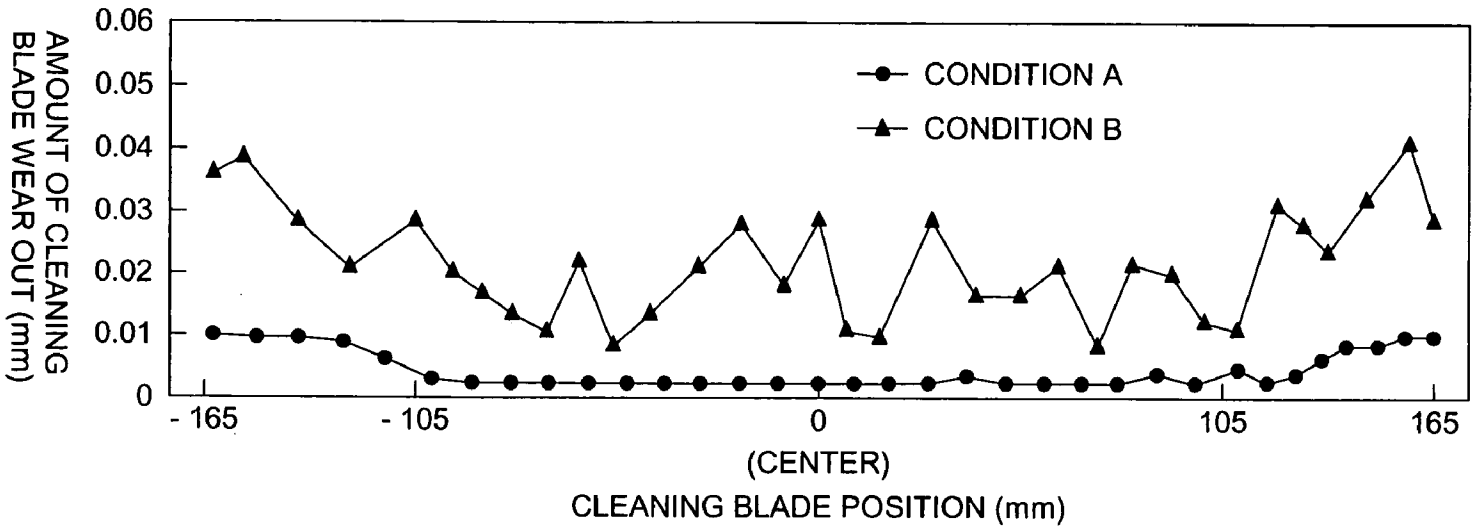
FIG. 20 is a graph showing the rate of cleaning blade wear out in the comparison experiment-2.

The environmental conditions under which the comparison experiments were made were set, similar to that in the Comparison Experiment—1, at an ambient temperature of 33° C. and an ambient relative humidity of 85%, the paper size was A4, and image formation of a printing ratio of 5% was made on paper for successive 100,000 sheets of paper fed with the longer side parallel to the direction of paper transportation, and the results shown in FIG. 20 were obtained in this comparison experiment.

Similar to FIG. 18, the horizontal axis in the figure represents the position along the cleaning blade in the paper width direction, and the vertical axis represents the wear out length (amount of wear out) of the edge section of the cleaning blade.

Figure 21:
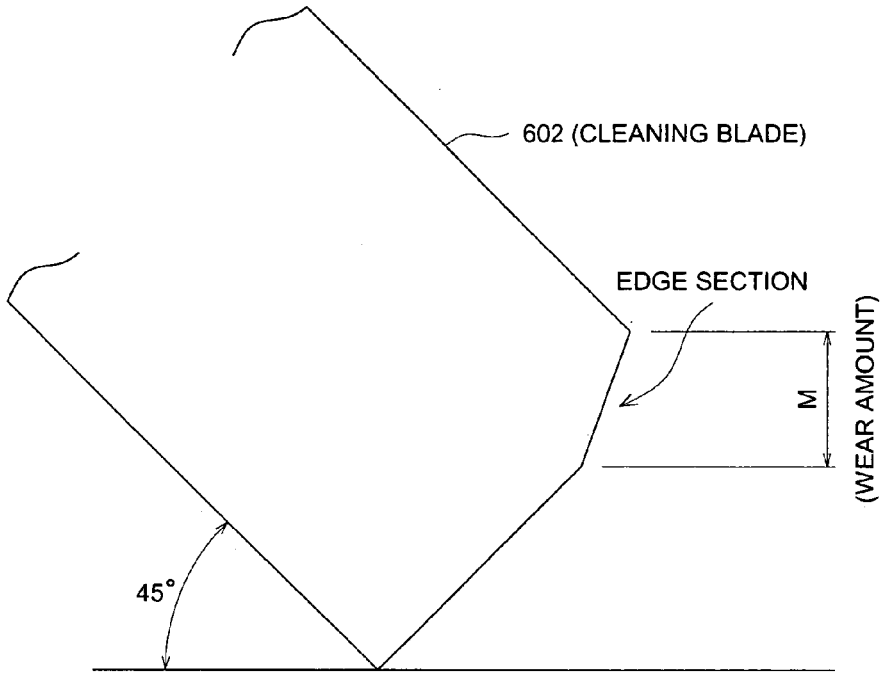
FIG. 21 is a schematic diagram of the method of measuring the amount of wear out of the cleaning blade.
Figure 22:
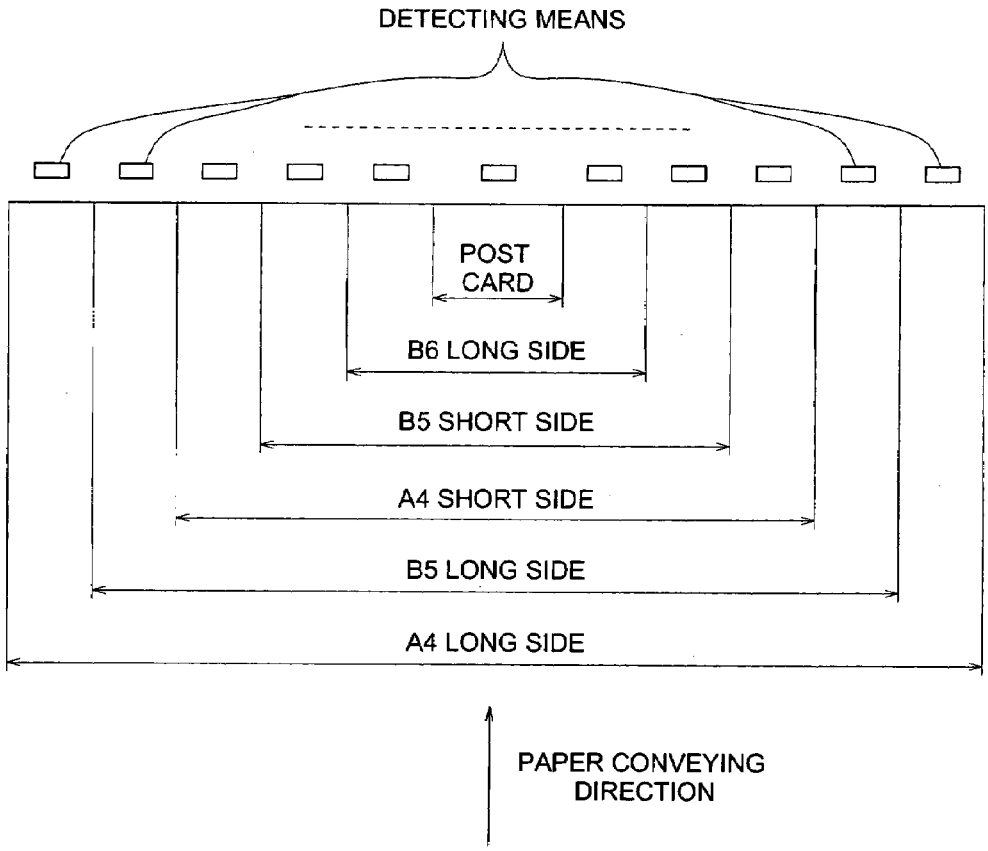
FIG. 22 is a diagram of a preferred embodiment showing an example of installing detection means.

The amount of wear out, as is shown in FIG. 21, is the length of wear out of the edge part of the cleaning blade as viewed in the vertical direction when the cleaning blade is tilted at an angle of 45° to the horizontal direction.

As is evident from FIG. 20, while there was wear out of 0.01 mm to 0.04 mm over the entire range of the paper width under the Condition B, the wear out under Condition A was less than 0.01 mm and hence the wear out in the present preferred embodiment was within a level that presents no problems during practical use.

As described above, from the results of the comparison experiments 1 and 2, it is possible to solve the problems of bending of the cleaning blade, damage to the cleaning blade edge, toner filming, and pitch variations of the image, etc., without being affected by the printing width or the printing ratio, because the configuration is such that plural detection means are provided that detect the quantity of toner accumulated in the space S, and when it is judged from any one of these detection means that the quantity of toner is low, toner bands are formed on the image carrier corresponding to that detection means, and when it is judged that the quantity of toner accumulated in the space S is large, carrying out control so that the corresponding toner discharge restricting member is separated from the toner guide member, because of which toner is supplied at all times to the edge part of the cleaning blade.

Furthermore, apart from the preferred embodiment described above, it is possible to make the different configurations, means and members have the following forms.

When it is detected that the quantity of toner accumulated in the space is low by one of the plural detection means, instead of forming toner bands, it is also permissible to carry out control so that the toner discharge restricting member corresponding to that detection means come into contact with the toner guide.

As is shown in FIG. 21, it is also possible to select the placement of the detection means and the corresponding toner discharge restricting member in accordance with the different paper sizes.

It is also possible to carry out control of the quantity of toner accumulated in the space by having a configuration in which two detection means are provided at each location so that the upper limit and lower limit of the toner level are detected.

It is also possible to provide one detection means as seen from the direction of the paper width, and to control the quantity of toner accumulated in the space.

In the second embodiment of the cleaning section, by means of controlling the quantity of toner accumulated in the space so that the quantity of toner to be supplied to the image carrier is maintained to be 0.2 mg/cm$^2$ through 1.5 mg/cm$^2$, a preferable result was obtained in the same way as the first embodiment of the cleaning section.

Although the cleaning means according to the present invention was provided for the intermediate image transfer body in the present preferred embodiment, it is not necessary to restrict the application of the present invention to this, but it is also possible to provide the present cleaning means to a photosensitive body that transfers image to the intermediate image transfer body, or to a photosensitive body that directly transfers the toner image to the paper.

What is claimed is:

1. An image forming apparatus, comprising:

(1) an image forming section to form a toner image;

(2) an image carrying member being rotatable and to carry the toner image;

(3) a transferring section to transfer the toner image from the image carrying member to a recording sheet, and (4) a cleaning section located sequentially after the transferring section in a rotation direction of the image carrying member structured to remove residual toner remaining on the image carrying member after the toner image is transferred to the recording sheet at the transferring section and including:

a cleaning blade being in contact with the image carrying member and a toner supplying section located sequentially before the contact point of the cleaning blade and sequentially after the transferring section in the rotating direction of the image carrying member structured to supply toner to the image carrying member at a location sequentially after the transferring section; the toner supplying section including a toner storing section to store toner removed by the cleaning blade and a roller member being in contact with the image carrying member so that the toner supplying section supplies the removed toner to the image carrying member.

2. The image forming apparatus of claim 1, wherein the amount of toner supplied by the toner supplying section to the image carrying member is 0.2 mg/cm$^2$ to 1.5 mg/cm$^2$.

3. The image forming apparatus of claim 2, wherein the amount of toner is 0.2 mg/cm$^2$ to 0.6 mg/cm$^2$.

4. The image forming apparatus of claim 1, wherein the toner storing section is a container provided below the roller member and the roller member rotates to supply toner from the container to the image carrying member.

5. The image forming apparatus of claim 4, wherein the roller member is a brush roller.

6. The image forming apparatus of claim 1, wherein the toner storing section includes a plate member located to face the roller member and to come in contact with the roller member so that the toner storing section is provided above the roller member between the plate member and the roller member.

7. The image forming apparatus of claim 6, wherein the plate member is a toner discharging regulating member to regulate toner discharged from the storing section.

8. The image forming apparatus of claim 7, wherein the toner discharging regulating member maintains the toner amount stored in the toner storing section to be a predetermined amount.

9. The image forming apparatus of claim 7, wherein the contact pressure of the toner discharging regulating member being in contact with the roller member is higher at both side regions than at a central region on the rotation axis direction of the roller member.

10. The image forming apparatus of claim 7, wherein the length L1 of the cleaning blade, the length L2 of the roller member and the length L3 of the toner discharging regulating member satisfy the following relationship:

$L1 > L2 \geqq L3$.

11. The image forming apparatus of claim 7, wherein the roller member is a sponge roller and the sponge roller rotates in the same direction with the image carrying member at the contact point with the image carrying member and the peripheral speed of the sponge roller is faster than that of the image carrying member.

12. The image forming apparatus of claim 7, wherein the toner supplying section further includes a detector to detect a toner amount stored in the toner storing section and a control section to control such that when judging that the toner amount detected by the detector is smaller than a predetermined amount, the control section controls the image forming section to form a toner image on the image carrying member so as to supply the toner image to the cleaning section.

13. The image forming apparatus of claim 12, wherein the detector is located above the contact point of the cleaning blade being in contact with the image carrying member.

14. The image forming apparatus of claim 13, wherein the detector includes a piezo-electric element.

15. The image forming apparatus of claim 13, wherein the image forming section forms a toner image on a photoreceptor and the image carrying member is an intermediate transfer member to which the toner image is transferred from the photoreceptor, wherein the image forming section forms a belt-shaped image as a toner image on the intermediate transfer member through the photoreceptor for each time that the intermediate transfer member moves a predetermined distance.

16. The image forming apparatus of claim 15, wherein when the width of a recording sheet is less than 260 mm, the image forming section forms a belt-shaped image on the intermediate transfer member for each time that the intermediate transfer member moves 5 m, and wherein the belt-shaped image has a width corresponding to the maximum printing width in the main scanning direction and a length of 10 mm or more in the sub-scanning direction.

17. The image forming apparatus of claim 15, wherein when the width of a recording sheet is more than 260 mm and a printing ratio is 5% or less, the image forming section forms a belt-shaped image on the intermediate transfer member for each time that the intermediate transfer member moves 20 m, and wherein the belt-shaped image has a width corresponding to the maximum printing width in the main scanning direction and a length of 10 mm or more in the sub-scanning direction.

18. The image forming apparatus of claim 15, wherein the toner supplying section includes a detector to detect a transfer residual toner amount and a memory to memory image data to form a belt-shaped image and when the detector detects that the a transfer residual toner amount is 0.2 $mg/cm^2$ or less, the toner forming section forms the belt-shaped image memorized in the memory on the intermediate transfer member.

19. The image forming apparatus of claim 18, wherein the belt-shaped image has a width corresponding to the maximum printing width in the main scanning direction and a length of 10 mm or more in the sub-scanning direction.

20. The image forming apparatus of claim 18, wherein the detector is a photo-sensor.

21. The image forming apparatus of claim 7, wherein the toner supplying section further includes a plurality of detectors to detect a toner amount stored in the toner storing section and a control section to control such that when judging that the toner amount detected by any one detector is smaller than a predetermined amount, the control section controls the image forming section to form a toner image on the image carrying member at a position corresponding to the any one detector so as to supply the toner image to the cleaning section.

22. The image forming apparatus of claim 7, wherein the toner supplying section further includes a detector to detect a toner amount stored in the toner storing section and a control section to control such that when judging that the toner amount detected by the detector is smaller than a predetermined amount, the control section controls the toner discharging regulating member to come in contact with the roller member, and when judging that the toner amount detected by the detector is larger than a predetermined amount, the control section controls the toner discharging regulating member to move away from the roller member.

23. The image forming apparatus of claim 22, wherein the toner discharging regulating member is divided into plural regulating members in the axial direction of the roller member and the toner supplying section further includes a plurality of detectors provided at positions corresponding to the plural regulating members and a control section and wherein the control section controls such that when judging that the toner amount detected by any one detector is smaller than a predetermined amount, the control section controls the toner discharging regulating member corresponding to the any one detector to come in contact with the roller member, and when judging that the toner amount detected by any one detector is larger than a predetermined amount, the control section controls the toner discharging regulating member corresponding to the any one detector to move away from the roller member.

24. An image forming method, comprising steps of:

(1) forming a toner image;

(2) carrying the toner image on a rotatable image carrying member;

(3) transferring the toner image from the image carrying member to a recording sheet by transferring section, and (4) cleaning residual toner remaining on the image carrying member with a cleaning blade being in contact with the image carrying member at a contact point located sequentially after the transferring section in a rotating direction of the image carrying member after the toner image is transferred to the recording sheet and (5) supplying toner to the image carrying member at a location sequentially before the contact point of the cleaning blade and at a location sequentially after the transferring section in the rotating direction of the image carrying member by a toner supplying section including a toner storing section to store the toner removed by the cleaning blade and a roller member being in contact with the image carrying member.

25. The image forming method of claim 24, wherein the amount of toner supplied by the toner supplying section to the image carrying member is 0.2 $mg/cm^2$ to 1.5 $mg/cm^2$.

26. The image forming method of claim 25, wherein the amount of toner is 0.2 $mg/cm^2$ to 0.6 $mg/cm^2$.

* * * * *